US007104086B2

(12) United States Patent
Mizutani et al.

(10) Patent No.: US 7,104,086 B2
(45) Date of Patent: Sep. 12, 2006

(54) REFRIGERATION APPARATUS

(75) Inventors: Kazuhide Mizutani, Sakai (JP); Hiromune Matsuoka, Sakai (JP); Atsushi Yoshimi, Sakai (JP); Manabu Yoshimi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 314 days.

(21) Appl. No.: 10/494,968

(22) PCT Filed: Jul. 7, 2003

(86) PCT No.: PCT/JP03/08626

§ 371 (c)(1),
(2), (4) Date: May 7, 2004

(87) PCT Pub. No.: WO2004/008050

PCT Pub. Date: Jan. 22, 2004

(65) Prior Publication Data

US 2005/0160762 A1 Jul. 28, 2005

(30) Foreign Application Priority Data

Jul. 10, 2002 (JP) ..... 2002-201173

(51) Int. Cl.
*F25B 43/00* (2006.01)
*F25B 43/04* (2006.01)
*F25B 27/00* (2006.01)

(52) U.S. Cl. ..... 62/474; 62/324.4; 62/475

(58) Field of Classification Search ..... 62/324.4, 62/474, 475

See application file for complete search history.

(56) References Cited

U.S. PATENT DOCUMENTS

2002/0026800 A1* 3/2002 Kasai et al. ..... 62/85

FOREIGN PATENT DOCUMENTS

| | | |
|---|---|---|
| JP | S51-002050 | 1/1976 |
| JP | H01-008927 | 3/1989 |
| JP | 6-255351 A | 9/1994 |
| JP | H07-305921 | 11/1995 |
| JP | 8-075323 A | 3/1996 |
| JP | H08-094216 | 4/1996 |
| JP | 9-318197 A | 12/1997 |
| JP | 2000-274887 A | 10/2000 |
| JP | 2001-027460 | 1/2001 |
| JP | 2001-041613 A | 2/2001 |
| JP | 2001-147059 A | 5/2001 |
| JP | 2001-255044 A | 9/2001 |
| JP | 2003-042603 | 2/2003 |

* cited by examiner

*Primary Examiner*—Cheryl Tyler
*Assistant Examiner*—B. Clayton McCraw
(74) *Attorney, Agent, or Firm*—Global IP Counselors

(57) ABSTRACT

A refrigeration apparatus is provided with a vapor compression type refrigerant circuit. With this apparatus, reliability from the standpoint of the pipe cleaning mode of the apparatus is improved. The air conditioning system has a main refrigerant circuit that has a compressor, a heat-source-side heat exchanger, and a user-side heat exchanger. The air conditioning system also has a contaminant collecting device provided on the intake side of the compressor (21). The contaminant collecting device is equipped with a contaminant collecting container, an inlet pipe, an outlet pipe, and a main opening/closing device. The contaminant collecting container separates contaminants from refrigerant flowing in the intake gas pipe toward the compressor when the refrigerant is directed through it. The inlet and outlet pipes are each provided with a return preventing shape for preventing contaminants that have accumulated inside the pipes from returning to the intake gas pipe.

22 Claims, 16 Drawing Sheets

REFRIGERATION APPARATUS

TECHNICAL FIELD

The present invention relates to a refrigeration apparatus. More particularly, the present invention relates to a refrigeration apparatus provided with a vapor compression type refrigerant circuit.

BACKGROUND ART

One example of a refrigeration apparatus provided with conventional vapor compression type refrigerant circuits is air conditioning systems used to air-condition office buildings. This kind of air conditioning system includes chiefly a heat source unit having a compressor and a heat-source-side heat exchanger, a plurality of user units having user-side heat exchangers, and gaseous refrigerant piping and liquid refrigerant piping for connecting said units together. In view of such environmental concerns as destruction of the ozone layer, HFC (hydro-fluorocarbon) based refrigerants and HC (hydrocarbon) based refrigerants have come to be used in this kind of air conditioning system.

When air conditioning systems in existing buildings are replaced, the existing gaseous refrigerant piping and liquid refrigerant piping are sometimes used in order to reduce the cost and time required for the replacement work. In such cases, the air conditioning system installation work proceeds according to the following steps:

1) Recover refrigerant
2) Install equipment
3) Install piping and wiring (reuse existing gaseous refrigerant piping and liquid refrigerant piping)
4) Perform airtightness test
5) Pull vacuum
6) Charge system with refrigerant
7) Perform test run With this work procedure, the work time can be reduced chiefly by simplifying the piping and wiring work.

However, debris, oil, and other residual contaminants that remain in existing gaseous refrigerant pipes and liquid refrigerant pipes must be removed by cleaning the piping before performing a test run of the system. More particularly, if old oil for CFC (chlorofluorocarbon) or HCFC (hydro-chlorofluorocarbon) based refrigerants remains in the existing gaseous refrigerant piping and liquid refrigerant piping when existing gaseous and liquid refrigerant piping is reused for a new air conditioning system, the old refrigerant oil will not be compatible with the new oil for the HFC or HC based refrigerant and will behave as a contaminant in the refrigerant circuit, possibly clogging expansion valves and capillaries in the refrigerant circuit and damaging the compressor.

The oils used for the conventional CFC and HCFC based refrigerants are naphthene-based mineral oils and other non-polar oils. Conversely, the oils used for the newer HFC and HC based refrigerants are ester-based and ether-based mineral oils and other non-polar oils. Consequently, if oil for the CFC or HCFC based refrigerant remains in the piping, the solubility of the oil in the refrigerant will change and the proper refrigeration performance will not be obtained from the HFC or HC based refrigerant. Thus, it is also necessary to clean the piping in view of this issue of oil compatibility.

An air conditioning system that enables existing gaseous refrigerant piping and liquid refrigerant piping to be used is disclosed in Japanese Laid-Open Patent Publication No. 2001-41613. This air conditioning system is provided with a main refrigerant circuit that includes a compressor, a user-side heat exchanger, and a heat-source-side heat exchanger and an oil recovery device provided in the gas intake pipe of the compressor. After the air conditioning system is charged with the HFC based refrigerant, the compressor is run in a mode (pipe cleaning mode) that circulates the refrigerant and cleans the piping with the circulated refrigerant. The residual oil that remained in the existing gaseous refrigerant piping and liquid refrigerant piping is recovered by the oil recovery device.

The oil recovery device is provided in such a manner as to bypass a portion of the gas intake pipe. Thus, with this air conditioning system, the refrigerant circuit can be changed over so that the oil recovery device is not used during normal operation. However, after operation in pipe cleaning mode, contaminants including old refrigerant oil remain in the branched inlet and outlet pipes that lead into and out of the oil recovery device from the gas intake pipe and there is the possibility that these contaminants will be returned to the gas intake pipe and cause damage to the compressor downstream or other problems when the system is operated in a normal mode.

Furthermore, there is a gate valve installed at the outlet side of the oil recovery device for disconnecting the oil recovery device from the main refrigerant circuit. If liquid refrigerant remains in the oil recovery device when the gate valve is closed after pipe cleaning mode, overpressuring of the container might occur due to evaporation of the residual liquid refrigerant.

Also, there are times when pipe cleaning using such an oil recovery device is conducted by circulating refrigerant that is in a wet state (gas-liquid two-phases) through the refrigerant circuit. When this type of operation is conducted, liquid refrigerant collects in the oil recovery device and causes the quantity of refrigerant circulating through the refrigerant circuit to decrease, which sometimes impedes sufficient cleaning of the piping.

Thus, in some respects, conventional system configurations utilizing an oil recovery device are not sufficiently reliable when the system is run in pipe cleaning mode.

DISCLOSURE OF THE INVENTION

The object of the present invention is to improve the reliability of refrigeration apparatuses provided with vapor compression type refrigerant circuits from the standpoint of the pipe cleaning mode.

According to a first aspect of the present invention, the refrigeration apparatus is provided with a vapor compression type main refrigerant circuit, a contaminant collecting container, an inlet pipe, an outlet pipe, and a main opening/closing device. The vapor compression type refrigerant circuit includes a compressor, a user-side heat exchanger, a heat-source-side heat exchanger, and a gaseous refrigerant circuit that connects the user-side heat exchanger and the compressor together. The contaminant collecting container is configured such that it can separate contaminants from the refrigerant when refrigerant flowing in the gaseous refrigerant circuit is directed there-through. The inlet pipe branches from the gaseous refrigerant circuit in order to direct refrigerant into the contaminant collecting container and connects to the inlet of the contaminant collecting container in such a manner that contaminants that have accumulated in the contaminant collecting container do not return to the gaseous refrigerant circuit. The outlet pipe branches from the gaseous refrigerant circuit at the position downstream of where the inlet pipe branches and connects to the outlet of the contaminant collecting container in order to return refrigerant from which the contaminants have been separated by the contaminant collecting container to the gaseous refrigerant circuit. The main opening/closing device is configured such that it can shut off the flow of refrigerant between the part of the gaseous refrigerant circuit where the inlet pipe branches therefrom and the part of the gaseous refrigerant circuit where the outlet pipe branches therefrom.

The refrigeration apparatus is designed such that after the refrigeration apparatus is installed, the main opening/closing device can be operated such that refrigerant will pass through the contaminant collecting container. Then, by operating the compressor and circulating the refrigerant, contaminants in the main refrigerant circuit are directed along with refrigerant through the inlet pipe and into the contaminant collecting container, where only the contaminants are separated and collected. The refrigerant from which the contaminants have been removed is then returned to the gaseous refrigerant circuit from the contaminant collecting container through the outlet pipe. As a result, the refrigerant that is drawn into the compressor downstream of the contaminant collecting container is refrigerant from which the contaminants have been removed and compressor damage and other problems occur less easily. The contaminants mentioned here are debris, oils, etc., remaining in the refrigerant circuit after installation of the refrigeration apparatus. In cases where an existing refrigeration apparatus using a CFC or HCFC based refrigerant is replaced with a new refrigeration apparatus using an HFC or HC based refrigerant and the existing piping is left in place, the contaminants also include residual refrigerant oil for the CFC or HCFC based refrigerant.

After the contaminants have been collected in the contaminant collecting container, the main opening/closing device is operated such that refrigerant will not pass through the contaminant collecting container and the system is operated using the normal refrigerant circuit configuration. When this is done, there is the possibility that contaminants will have accumulated in the inlet pipe during contamination collection operation. However, since the inlet pipe is connected to the inlet of the contaminant collecting container in such a manner that contaminants cannot return to the gaseous refrigerant circuit, the possibility that contaminants accumulated in the inlet pipe will return to the gaseous refrigerant circuit can be reduced. As a result, even after the circuit configuration is changed, contaminants can be prevented from being drawn into the compressor installed downstream and the reliability of the system can be improved from the standpoint of pipe cleaning mode.

According to a second aspect of the present invention, the refrigeration apparatus of the first aspect of the present invention is provided, wherein the inlet pipe is formed to have a return preventing shape for preventing contaminants that have accumulated inside the inlet pipe from returning to the gaseous refrigerant circuit.

According to a third aspect of the present invention, the refrigeration apparatus of the first or second aspect of the present invention is provided, wherein the outlet pipe is connected to the outlet of the contaminant collecting container in such a manner that contaminants that have accumulated inside the outlet pipe do not return to the gaseous refrigerant circuit.

With this refrigeration apparatus, since the outlet pipe is connected to the outlet of the contaminant collecting container in such a manner that contaminants do not return to the gaseous refrigerant circuit, the possibility that contaminants accumulated in the outlet pipe will return to the gaseous refrigerant circuit can be reduced. As a result, even after the circuit configuration is changed, contaminants can be prevented from being drawn into the compressor installed downstream and the reliability of the system can be improved from the standpoint of pipe cleaning mode.

According to a fourth aspect of the present invention, the refrigeration apparatus of the third aspect of the present invention is provided, wherein the outlet pipe is formed to have a return preventing shape for preventing contaminants that have accumulated inside the outlet pipe from returning to the gaseous refrigerant circuit.

According to a fifth aspect of the present invention, the refrigeration apparatus of the second or fourth aspect of the present invention is provided, wherein the return preventing shape formed in the inlet and/or outlet pipe is a bend formed in the vicinity of the portion where the inlet and/or outlet pipe branches from the gaseous refrigerant circuit.

With this refrigeration apparatus, the structure is simple because the return preventing shape formed in the inlet and/or outlet pipe is a bend formed in the vicinity of the portion where the inlet and/or outlet pipe branches from the gaseous refrigerant circuit.

According to a sixth aspect of the present invention, the refrigeration apparatus of any one of the first to fifth aspects of the present invention is provided, wherein the portion of the gaseous refrigerant circuit in the vicinity of where the inlet and/or outlet pipe branches therefrom is formed such that it slopes upward toward the intake side of the compressor.

With this refrigeration apparatus, the possibility that contaminants accumulated in the inlet and/or outlet pipe will be drawn into the compressor can be reduced even further because the portion of the gaseous refrigerant circuit in the vicinity of where the inlet and/or outlet pipe branches therefrom is formed such that it slopes upward toward the intake side of the compressor.

According to a seventh aspect of the present invention, the refrigeration apparatus is provided with a vapor compression type main refrigerant circuit, a contaminant collecting container, an inlet pipe, an outlet pipe, and a main opening/closing device. The vapor compression type refrigerant circuit includes a compressor, a user-side heat exchanger, a heat-source-side heat exchanger, and a gaseous refrigerant circuit that connects the user-side heat exchanger and the compressor together. The contaminant collecting container is configured such that it can separate contaminants from the refrigerant flowing in the gaseous refrigerant circuit when the refrigerant is directed through it. The inlet pipe branches from the gaseous refrigerant circuit in order to direct refrigerant into the contaminant collecting container and connects to the inlet of the contaminant collecting container. The outlet pipe branches from the gaseous refrigerant circuit at a position downstream of where the inlet pipe branches and connects to the outlet of the contaminant collecting container in order to return refrigerant from which the contaminants have been separated by the contaminant collecting container to the gaseous refrigerant circuit. The main opening/closing device is configured such that it can shut off the flow of refrigerant between the part of the gaseous refrigerant circuit where the inlet pipe branches therefrom and the part of the gaseous refrigerant circuit where the outlet pipe branches therefrom. The outlet pipe is also provided with a non-return device that only permits flow from the contaminant collecting container to the gaseous refrigerant circuit.

This refrigeration apparatus is designed such that after the refrigeration apparatus is installed, the main opening/closing device can be operated such that refrigerant will pass through the contaminant collecting container. Then, by operating the compressor and circulating the refrigerant, contaminants in the main refrigerant circuit are directed along with refrigerant through the inlet pipe and into the contaminant collecting container, where only the contaminants are separated and collected. The refrigerant from which the contaminants have been removed is then returned to the gaseous refrigerant circuit from the contaminant collecting container through the outlet pipe. As a result, the refrigerant that is drawn into the compressor downstream of the contaminant collecting container is refrigerant from which the contaminants have been removed and compressor damage and other problems occur less easily. The contaminants mentioned here are debris, oils, etc., remaining in the refrigerant circuit after installation of the refrigeration apparatus. In cases where an existing refrigeration apparatus using a CFC or HCFC based refrigerant is replaced with a new refrigeration apparatus using an HFC or HC based refrigerant and the existing piping is left in place, the contaminants also include residual refrigerant oil for the CFC or HCFC based refrigerant.

After the contaminants have been collected in the contaminant collecting container, the main opening/closing device is operated such that refrigerant will not pass through the contaminant collecting container and the system is operated using the normal refrigerant circuit configuration. When this is done, liquid refrigerant may have accumulated in the contaminant collecting container along with the collected contaminants. However, since a non-return device is provided in the outlet pipe, gaseous refrigerant that has evaporated inside the contaminant collecting container can be returned to the gaseous refrigerant circuit even during normal operation. Thus, loss of the refrigerant charged in the main refrigerant circuit can be reduced and overpressuring of the contaminant collecting container can be prevented. As a result, the reliability of the system can be improved from the standpoint of pipe cleaning mode.

According to an eighth aspect of the present invention, the refrigeration apparatus is provided with a vapor compression type main refrigerant circuit, a contaminant collecting container, an inlet pipe, an outlet pipe, and a main opening/closing device. The vapor compression type refrigerant circuit includes a compressor, a user-side heat exchanger, a heat-source-side heat exchanger, and a gaseous refrigerant circuit that connects the user-side heat exchanger and the compressor together. The contaminant collecting container is configured such that it can separate contaminants from refrigerant flowing in the gaseous refrigerant circuit when the refrigerant is directed through it. The inlet pipe branches from the gaseous refrigerant circuit and connects to the inlet of the contaminant collecting container in order to direct refrigerant into the contaminant collecting container. The outlet pipe branches from the gaseous refrigerant circuit at a position downstream of where the inlet pipe branches and connects to the outlet of the contaminant collecting container in order to return refrigerant from which the contaminants have been separated by the contaminant collecting container to the gaseous refrigerant circuit. The main opening/closing device is configured such that it can shut off the flow of refrigerant between the part of the gaseous refrigerant circuit where the inlet pipe branches therefrom and the part of the gaseous refrigerant circuit where the outlet pipe branches therefrom. Additionally, the contaminant collecting container is provided with a heating device for heating the inside thereof.

This refrigeration apparatus is designed such that after the refrigeration apparatus is installed, the main opening/closing device can be operated such that refrigerant will pass through the contaminant collecting container. Then, by operating the compressor and circulating the refrigerant, contaminants in the main refrigerant circuit are directed along with refrigerant through the inlet pipe and into the contaminant collecting container, where only the contaminants are separated and collected. The refrigerant from which the contaminants have been removed is then returned to the gaseous refrigerant circuit from the contaminant collecting container through the outlet pipe. As a result, the refrigerant that is drawn into the compressor downstream of the contaminant collecting container is refrigerant from which the contaminants have been removed and compressor damage and other problems occur less easily. The contaminants mentioned here are debris, oils, etc., remaining in the refrigerant circuit after installation of the refrigeration apparatus. In cases where an existing refrigeration apparatus using a CFC or HCFC based refrigerant is replaced with a new refrigeration apparatus using an HFC or HC based refrigerant and the existing piping is left in place, the contaminants also include residual refrigerant oil for the CFC or HCFC based refrigerant.

After the contaminants have been collected in the contaminant collecting container, the main opening/closing device is operated such that refrigerant will not pass through the contaminant collecting container and the system is operated using the normal refrigerant circuit configuration. When this is done, liquid refrigerant may have accumulated in the contaminant collecting container along with the collected contaminants. More specifically, when the refrigerant is circulated in a wet state (gas-liquid two-phases), liquid refrigerant is delivered to the contaminant collecting container and the quantity of liquid refrigerant accumulated in the contaminant collecting container increases. Consequently, the quantity of refrigerant circulating through the refrigerant circuit decreases, possibly resulting in insufficient cleaning of the piping. However, since a heating device is provided in the contaminant collecting container, liquid refrigerant that has accumulated inside the contaminant collecting container can be heated, evaporated, and returned to the main refrigerant circuit to ensure a sufficient quantity of circulating refrigerant. As a result, the reliability of the system can be improved from the standpoint of pipe cleaning mode.

According to a ninth aspect of the present invention, the refrigeration apparatus of the eighth aspect of the present invention is provided, wherein the heating device is a heat exchanger that uses a portion of the gaseous refrigerant discharged from the compressor as a heat source.

With this refrigeration device, the heat of the comparatively high-temperature gaseous refrigerant discharged from the compressor can be utilized effectively.

According to a tenth aspect of the present invention, the refrigeration apparatus of the eighth aspect of the present invention is provided, wherein the heating device is a heat exchanger that uses a portion of the liquid refrigerant flowing in the liquid refrigerant circuit as a heat source.

With this refrigeration device, the heat of the liquid refrigerant flowing through the liquid refrigerant circuit can be utilized effectively.

According to an eleventh aspect of the present invention, the refrigeration apparatus of the eighth aspect of the present invention is provided, wherein the heating device is an electric heating unit.

With this refrigeration apparatus, the contaminant collecting container can be heated regardless of the operating conditions of the refrigerant circuit because the electric heating unit is used.

According to a twelfth aspect of the present invention, the refrigeration apparatus of the eighth aspect of the present invention is provided, wherein the heating device is the heat exchanger that uses an external heat source.

This refrigeration apparatus is effective when the system is installed under circumstances where the exhaust heat of an external device can be used as an external heat source.

According to a thirteenth aspect of the present invention, the refrigeration apparatus of any one of the first to twelfth aspects of the present invention is provided, wherein the main opening/closing device has the additional function of shutting off the flow of refrigerant from the gaseous refrigerant circuit to the inlet pipe.

With this refrigeration apparatus, the number of component parts related to changing over the circuit can be reduced because the main opening/closing device can switch between a function of shutting of the flow of refrigerant between the part of the gaseous refrigerant circuit where the inlet pipe branches therefrom and the part of the gaseous refrigerant circuit where the outlet pipe branches therefrom and a function of shutting off the flow of refrigerant from the gaseous refrigerant circuit to the inlet pipe.

According to a fourteenth aspect of the present invention, the refrigeration apparatus of any one of the first to thirteenth aspects of the present invention is provided, wherein the inlet and outlet of the contaminant collecting container are provided on the top of the container.

With this refrigeration apparatus, the contaminants in the refrigerant directed through the inlet pipe are collected in the bottom of the contaminant collecting container because the inlet and outlet of the container are provided on the top of the container. As a result, the possibility of the collected contaminants returning to the gaseous refrigerant circuit through the outlet can be reduced and the reliability of the system can be improved from the standpoint of pipe cleaning mode.

According to a fifteenth aspect of the present invention, the refrigeration apparatus of the fourteenth aspect of the present invention is provided, wherein the contaminant collecting container is provided with a guide pipe that extends from the top of the container to the bottom of the container and serves to guide refrigerant that has entered through the inlet of the container to the bottom of the container.

With this refrigeration apparatus, the contaminant-containing refrigerant that flows into the contaminant collecting container through the inlet is guided to the bottom of the container by the guide pipe provided in the contaminant collecting container so that the flow of refrigerant can be prevented from short-circuiting from the inlet directly to the outlet. As a result, the possibility of the collected contaminants returning to the gaseous refrigerant circuit through the outlet can be reduced and the reliability of the system can be improved from the standpoint of pipe cleaning mode.

According to a sixteenth aspect of the present invention, the refrigeration apparatus of the fourteenth aspect of the present invention is provided, wherein a partitioning plate is provided inside the contaminant collecting container to separate the space in the vicinity of the container inlet and the space in the vicinity of the container outlet.

With this refrigeration apparatus, the contaminant-containing refrigerant that flows into the contaminant collecting container through the inlet is prevented from short-circuiting from the inlet directly to the outlet by the partitioning plate provided in the contaminant collecting container. As a result, the possibility of the collected contaminants returning to the gaseous refrigerant circuit through the outlet can be reduced and the reliability of the system can be improved from the standpoint of pipe cleaning mode.

According to a seventeenth aspect of the present invention, the refrigeration apparatus of any one of the fourteenth to sixteenth aspects of the present invention is provided, wherein a filter is provided in the outlet of the contaminant collecting container.

With this refrigeration apparatus, collected contaminants can be prevented from returning to the gaseous refrigerant circuit with certainty because the filter is provided in the outlet of the contaminant collecting container.

According to an eighteenth aspect of the present invention, the refrigeration apparatus of any one of the fourteenth to seventeenth aspects of the present invention is provided, wherein a removal device for removing contaminants to the outside is provided on the bottom of the contaminant collecting container.

With this refrigeration device, collected contaminants can be removed from the contaminant collecting container.

According to a nineteen aspect of the present invention, the refrigeration apparatus of any one of the fourteenth to eighteenth aspects of the present invention is provided, wherein a pressure relief device for preventing overpressuring of the contaminant collecting container is provided on the top of the contaminant collecting container.

With this refrigeration apparatus, the pressure relief device provided on the contaminant collecting container prevents the pressure inside the contaminant collecting container from becoming excessive due to the evaporation of liquid refrigerant remaining in the contaminant collecting container after contaminants have been collected.

According to a twentieth aspect of the present invention, the refrigeration apparatus of any one of the first to nineteenth aspects of the present invention is provided, wherein an oil detecting device for detecting oil among the contaminants is provided in the inlet pipe or the inlet of the contaminant collecting container.

With this refrigeration apparatus, since during operation in pipe cleaning mode, the oil detecting device provided in the inlet pipe or the inlet of the contaminant collecting container can detect oil among the contaminants flowing into the contaminant collecting container, pipe cleaning mode can be completed when oil is no longer detected.

According to a twenty first aspect of the present invention, the refrigeration apparatus of any one of the first to twentieth aspects of the present invention is provided, wherein the inside of the contaminant collecting container is made of a corrosion resistant material or treated with a corrosion resistant coating to prevent corrosion caused by corrosive components among the contaminants.

With this refrigeration apparatus, the contaminant collecting container can be protected from corrosion caused by corrosive components among the contaminants because the contaminant collecting container is made of the corrosion resistant material or treated with the corrosion resistant coating.

According to a twenty second aspect of the present invention, the refrigeration apparatus of any one of the first to twenty first aspects of the present invention is provided, such a manner that it can be isolated therefrom.

With this refrigeration device, collected contaminants can be removed from the refrigeration apparatus together with the entire contaminant collecting container because the contaminant collecting container can be isolated from the gaseous refrigerant circuit.

BRIEF DESCRIPTIONS OF THE DRAWINGS

PREFERRED EMBODIMENTS OF THE INVENTION

Embodiments of refrigeration apparatuses in accordance with the present invention will now be described using the drawings.

Figure 1:
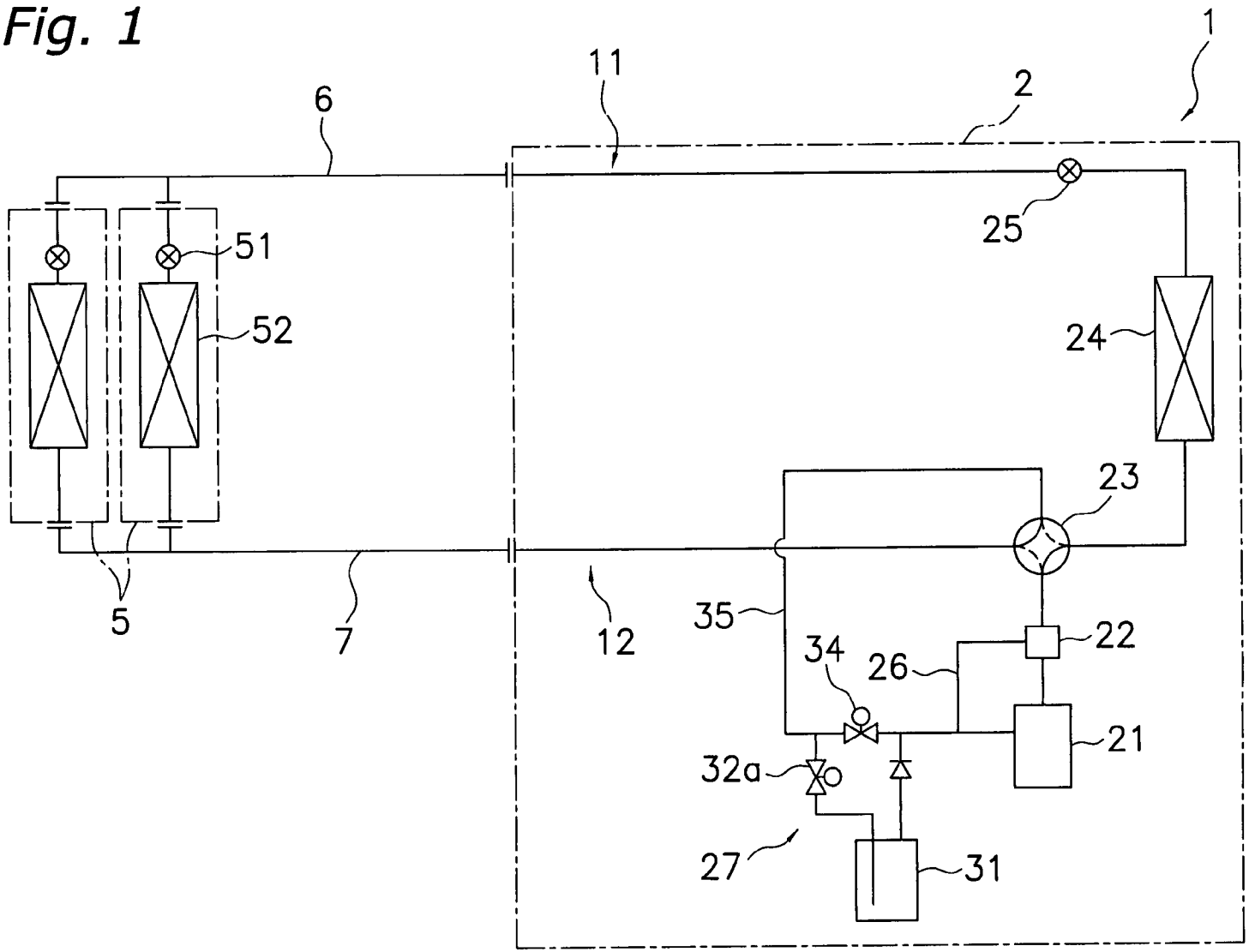
FIG. 1 is a schematic view of the refrigerant circuit of an air conditioning system in accordance with a first embodiment of the present invention.

FIRST EMBODIMENT (1) Constituent Features of the Air Conditioning System as a Whole FIG. 1 is a schematic view of the refrigerant circuit of an air conditioning system 1 in accordance with a first embodiment exemplifying a refrigeration apparatus in accordance with the present invention. The air conditioning system 1 is equipped with one heat source unit 2, a plurality of user units 5 (two in this embodiment) connected to the heat source unit 2 in parallel, and a liquid refrigerant pipe 6 and a gaseous refrigerant pipe 7 which are provided to connect the heat source unit 2 to the user units 5 and is designed to perform both heating and cooling in order to air-condition, for example, an office building.

The air conditioning system 1 uses an HFC or HC based refrigerant. In this embodiment, the air conditioning system 1 is obtained by replacing the heat source unit and user units of an air conditioning system that used a CFC or HCFC based refrigerant with the heat source unit 2 and user units 5. Thus, the liquid refrigerant pipe 6 and the gaseous refrigerant pipe 7 are the previously existing liquid refrigerant pipe and gaseous refrigerant pipe.

The user unit 5 is equipped chiefly with a user-side expansion valve 51 and a user-side heat exchanger 52. In this embodiment, the user-side expansion valve 51 is an electric powered expansion valve whose opening can be adjusted and is connected to the liquid-side of the user-side heat exchanger 52 for the purpose of adjusting the refrigerant pressure and the refrigerant flow rate. In this embodiment, the user-side heat exchanger 52 is a cross fin-type heat exchanger configured to exchange heat with the air inside the room. In this embodiment, the user unit 5 is provided with a fan (not shown in the figures) for drawing air from the room into the unit and blowing it back out so that heat can be exchanged between the air in the room and the refrigerant flowing through the user-side heat exchanger 52.

The heat source unit 2 is equipped chiefly with a compressor 21, an oil separator 22, a four-way selector valve 23, a heat-source-side heat exchanger 24, and a heat-source-side expansion valve 25. In this embodiment, the compressor 21 is a scroll type compressor that is driven by an electric motor and serves to compress the gaseous refrigerant it draws into itself. An ester-based oil or ether-based oil that is compatible with HFC and HC based refrigerants is used to lubricate the inside of the compressor 21. Provided on the discharge side of the compressor, the oil separator 22 is a vessel configured to separate oil from the compressed gaseous refrigerant discharged from the compressor by means of vapor-liquid separation. The oil separated in the oil separator 22 is returned to the intake side of the compressor 21 through an oil return pipe 26. The four-way selector valve 23 is configured such that it can change the flow direction of the refrigerant when the system is switched between cooling mode and heating mode. During cooling mode, it connects the outlet of the oil separator 22 to the gas side of the heat-source-side heat exchanger 24 and connects the inlet side of the compressor 21 to the gaseous refrigerant pipe 7. Meanwhile, during heating mode, it connects the outlet of the oil separator 22 to the gaseous refrigerant pipe 7 and connects the intake side of the compressor 21 to the gas side of the heat-source-side heat exchanger 24. In this embodiment, the heat-source-side heat exchanger 24 is a cross fin-type heat exchanger configured to exchange heat between the refrigerant and air, the air being used as a heat source. In this embodiment, the heat source unit 2 is provided with a fan (not shown in the figures) for drawing outdoor air into the unit and blowing it back out so that heat can be exchanged between the outdoor air and the refrigerant flowing through the heat-source-side heat exchanger 24. The heat-source-side expansion valve 25 is an electric powered expansion valve whose opening can be adjusted and is connected to the liquid-side of the heat-source-side heat exchanger 24 for the purpose of adjusting the refrigerant pressure and the refrigerant flow rate.

The liquid refrigerant pipe 6 connects the liquid sides of the user-side heat exchangers 52 of the user units 5 to the liquid side of the heat-source-side heat exchanger 24 of the heat source unit 2. The gaseous refrigerant pipe 7 connects the gas sides of the user-side heat exchangers 52 of the user units 5 to the four-way selector valve 23 of the heat source unit 2. The portion of the refrigerant circuit from the user-side heat exchangers 52 to the heat-source-side heat exchanger 24 that includes the user-side expansion valves 51, the liquid refrigerant pipe 6, and the heat-source-side expansion valve 25 is defined as a liquid refrigerant circuit 11. Meanwhile, the portion of the refrigerant circuit from the user-side heat exchangers 52 to the heat-source-side heat exchanger 24 that includes the gaseous refrigerant pipe 7, the compressor 21, the oil separator 22, and the four-way selector valve 23 is defined as a gaseous refrigerant circuit 12. In short, the main refrigerant circuit of the air conditioning system 1 is made up of the liquid refrigerant circuit 11 and the gaseous refrigerant circuit 12.

The air conditioning system 1 of this embodiment is further provided with a contaminant collecting device 27 installed in the gaseous refrigerant circuit 12. The contaminant collecting device 27 serves to collect debris, oils, etc., remaining in the main refrigerant circuit after installation of the user units 5 and the heat source unit 2. It also serves to collect residual CFC or HCFC based refrigerant oil remaining in the reused liquid refrigerant pipe 6 and the gaseous refrigerant pipe 7 if the existing refrigeration apparatus used such refrigerants. In this embodiment, the contaminant collecting device 27 is installed inside the heat source unit 2 and is disposed on the intake side of the compressor 21 of the gaseous refrigerant circuit 12.

(2) Constituent Features of the Contaminant Collecting Device

Figure 2:
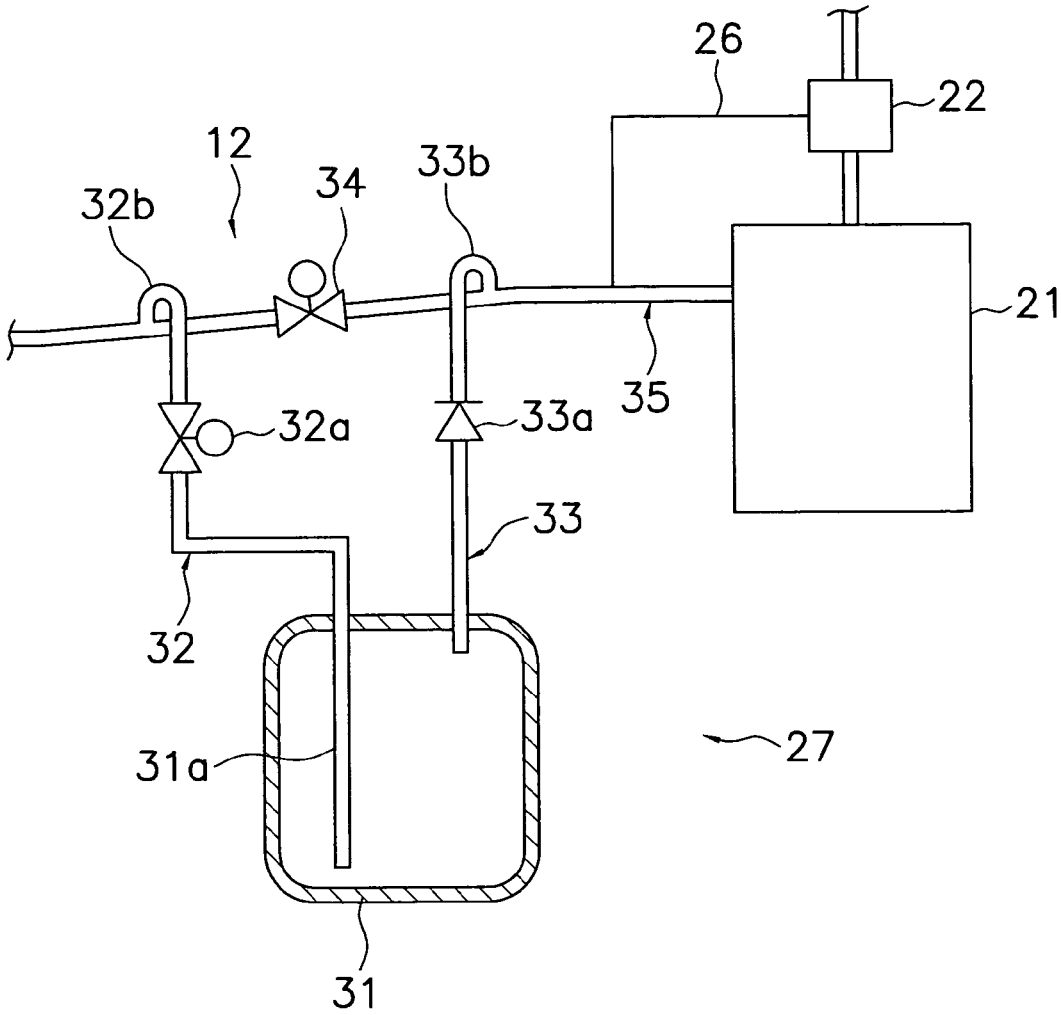
FIG. 2 is an enlarged partial view showing the vicinity of the contaminant collecting device (the contaminant collecting container is shown as a cross section) of the first embodiment.

FIG. 2 is an enlarged view showing the vicinity of the contaminant collecting device (the contaminant collecting container is shown as a cross section) of the air conditioning system 1 of this embodiment. The contaminant collecting device 27 is equipped with a contaminant collecting container 31, an inlet pipe 32, an outlet pipe 33, and a main opening/closing device 34.

The contaminant collecting container 31 is configured such that it can separate contaminants from the refrigerant flowing in the gaseous refrigerant circuit 12 when the refrigerant is directed through it. More specifically, the contaminant collecting container 31 is connected to an intake gas pipe 35 (which connects the four-way selector valve 23 to the intake side of the compressor 21) through the inlet pipe 32 and the outlet pipe 33. Since the intake gas pipe 35 is part of the gaseous refrigerant circuit 12, the contaminant collecting container 31 is connected to the gaseous refrigerant circuit 12.

Serving to direct refrigerant to the contaminant collecting container 31, the inlet pipe 32 branches from the intake gas pipe 35 and connects to the inlet of the contaminant collecting container 31. The position where the inlet pipe 32 branches is upstream of the oil return pipe 26 so that oil from the oil separator 22 will not be directed into the contaminant collecting container 31. The inlet pipe 32 is provided with an inlet opening/closing device 32*a* for turning on and shutting off the flow of refrigerant to the inlet of the contaminant collecting container 31. In this embodiment, the inlet opening/closing device 32*a* is a solenoid valve. The inlet pipe 32 is also provided with a return preventing shape 32*b* for preventing contaminants that have accumulated inside the inlet pipe 32 from returning to the intake gas pipe 35. More specifically, the return preventing shape 32*b* is a bent shape formed in the inlet pipe 32 in the vicinity of where it branches from the intake gas pipe 35. In this embodiment, the bent shape of the return preventing shape 32*b* is such that it extends upward to a position above the height position of the part that branches from the intake gas pipe 35 and then extends downward.

Serving to return refrigerant from which the contaminants have been separated by the contaminant collecting container 31 to the gaseous refrigerant circuit 12, the outlet pipe 33 branches from the intake gas pipe 35 at a position downstream of where the inlet pipe branches 32 and connects to the outlet of the contaminant collecting container 31. Similarly to the inlet pipe 32, the position where the outlet pipe 33 branches is upstream of the oil return pipe 26 so that oil from the oil separator 22 will not flow into the outlet pipe 33. The outlet pipe 33 is also provided with a non-return device 33*a* that only permits flow from the contaminant collecting container 31 to the intake gas pipe 35. In this embodiment, the non-return device 33*a* is a check valve. Similarly to the inlet pipe 32, the inlet pipe 33 is also provided with a return preventing shape 33*b* for preventing contaminants that have accumulated inside the outlet pipe 33 from returning to the intake gas pipe 35. In this embodiment, the bent shape of the return preventing shape 33*b* is such that, similarly to the return preventing shape 32*b*, it extends upward to a position above the height position of the part that branches from the intake gas pipe 35 and then extends downward.

The main opening/closing device 34 is configured such that it can shut off the flow of refrigerant between the part of the intake gas pipe 35 where the inlet pipe 32 branches therefrom and the part of the intake gas pipe 35 where the outlet pipe 33 branches therefrom. In this embodiment, the main opening/closing device 34 is a solenoid valve. The portion of the intake gas pipe 35 in the vicinity of where the inlet pipe 32 and outlet pipe 33 branch therefrom is formed such that it slopes upward toward the compressor 21.

The contaminant collecting container 31 is, for example, a vertically-oriented cylindrical container having an inlet and outlet provided on the top part thereof. The inlet of the contaminant collecting container 31 is provided with a guide pipe 31*a* serves to guide the refrigerant that flows in from the inlet pipe 32 to the bottom of the container. The contaminant collecting container 31 is made of stainless steel, copper, a copper alloy, or another corrosion resistant material in order to prevent corrosion caused by corrosive components among the contaminants.

(3) Operation of the Air Conditioning System

Figure 3:
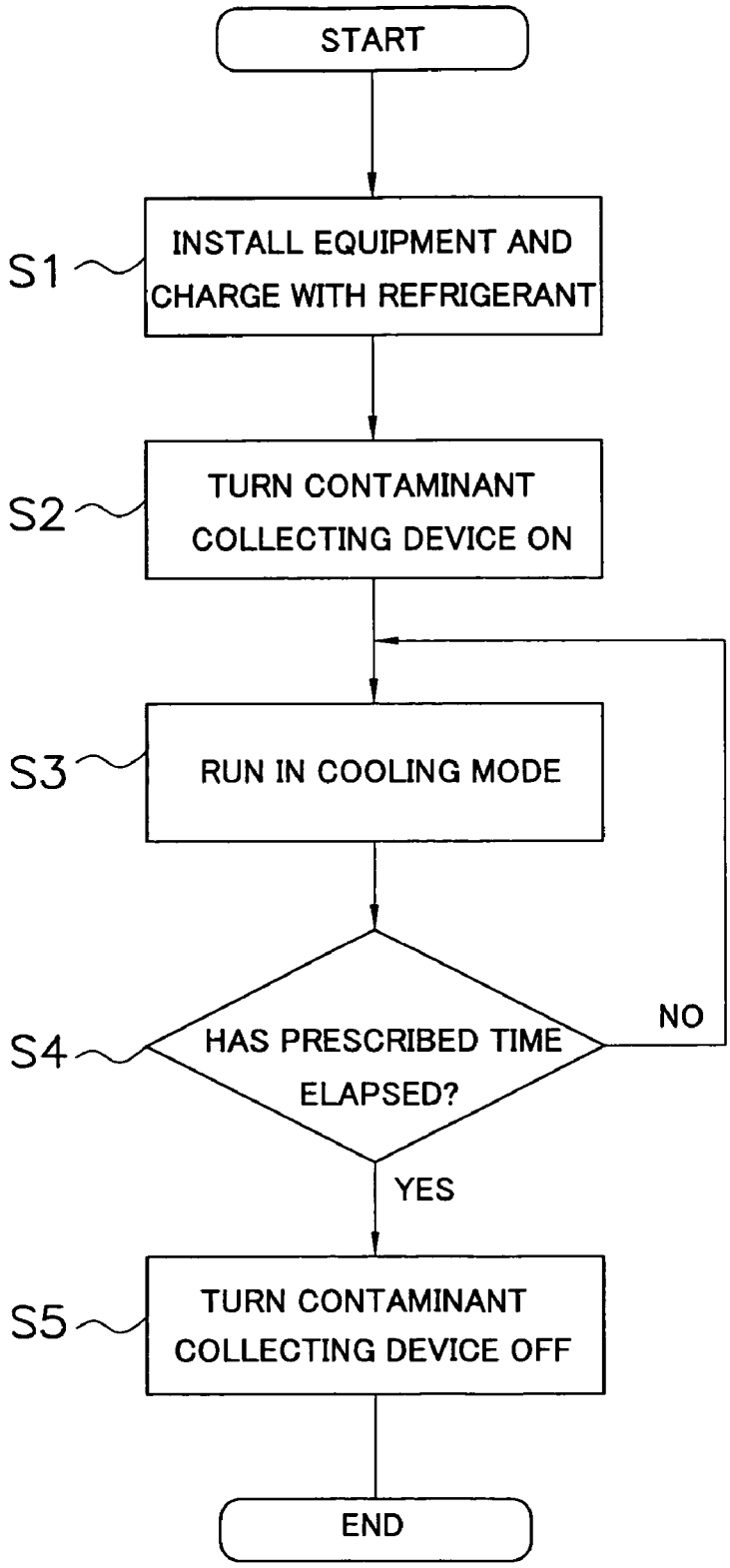
FIG. 3 is a flowchart for the pipe cleaning mode (gas cleaning) of the first embodiment.
Figure 4:
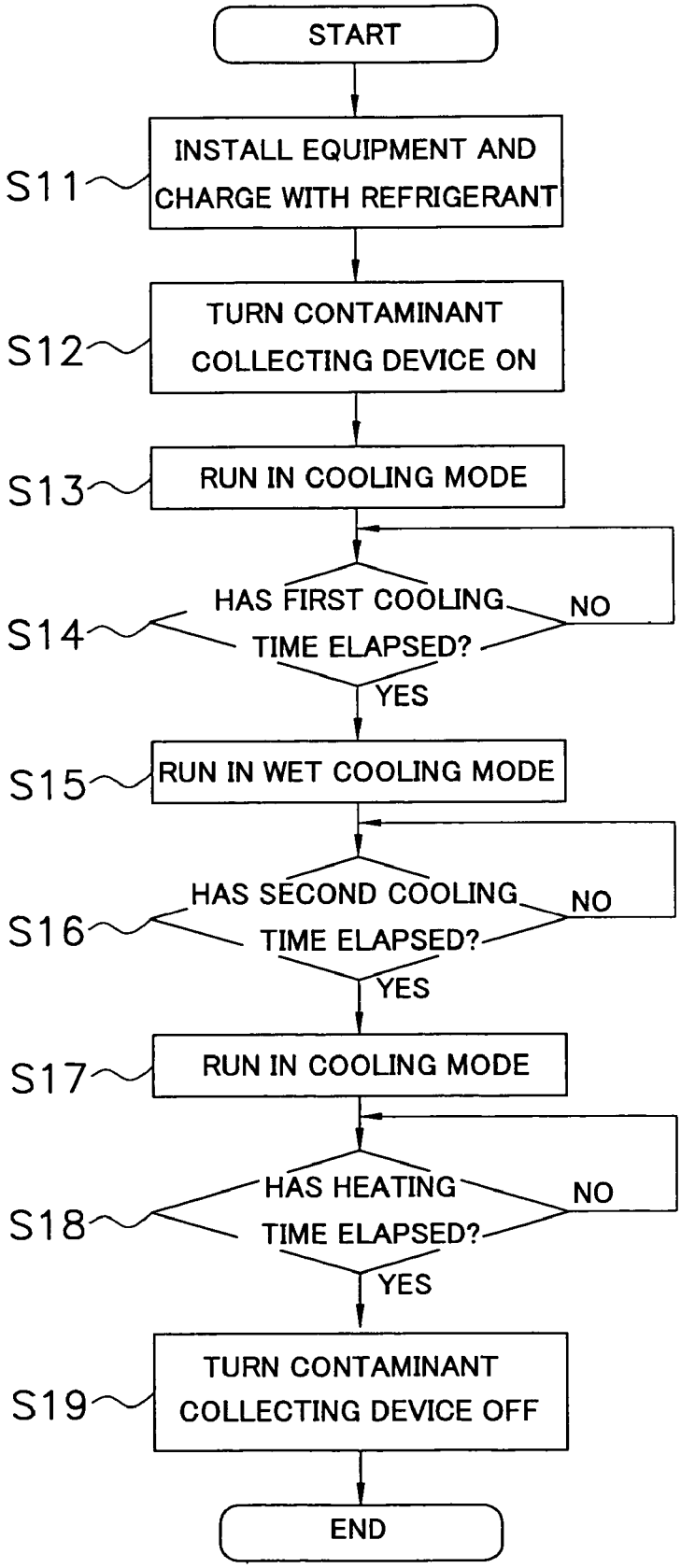
FIG. 4 is a flowchart for the pipe cleaning mode (liquid cleaning) of the first embodiment.

The operation of the air conditioning system 1 will now be described using FIGS. 1, 3, and 4. FIG. 3 is a flowchart for operation in the pipe cleaning mode (gas cleaning). FIG. 4 is a flowchart for operation in the pipe cleaning mode (liquid cleaning).

[1] Normal Operation (Cooling Mode)

First, cooling mode will be explained. During cooling mode, the four-way selector valve 23 is in the state indicated with solid lines in FIG. 1, i.e., in such a state that the discharge side of the compressor 21 is connected to the gas side of the heat-source-side heat exchanger 24 and the intake side of the compressor 21 is connected to the gas side of the user-side heat exchangers 52. The heat-source-side expansion valve 25 is fully open and the user-side expansion valves 51 are adjusted to an opening that reduces the pressure of the refrigerant. The main opening/closing device 34 is opened and the inlet opening/closing device 32*a* is closed such that the contaminant collecting device 27 is not used.

When the main refrigerant circuit in this state and the fan (not shown) of the heat source unit 2, the fans (not shown) of the user units 5, and the compressor 21 are started, the gaseous refrigerant drawn into the compressor 21 is compressed and sent to the oil separator 22, where the oil is separated by vapor-liquid separation. Then the compressed gaseous refrigerant is sent through the four-way selector valve 23 to the heat-source-side heat exchanger 24, where it is condensed by exchanging heat with the outside air. This condensed liquid refrigerant passes through the heat-source-side expansion valve 25 and the liquid refrigerant pipe 6 and flows to the user units 5. At the user units 5, the pressure of the liquid refrigerant is reduced by the user-side expansion valves 51 and then the liquid refrigerant is evaporated by exchanging heat with the air inside the room by means of the user-side heat exchangers 52. This evaporated gaseous refrigerant passes through the gaseous refrigerant pipe 7, the four-way selector valve 23, and the main opening/closing device 34 and is again drawn into the compressor 21. In this way, the system operates in cooling mode.

[2] Normal Operation (Heating Mode)

Now, heating mode will be explained. During heating mode, the four-way selector valve 23 is in the state indicated with broken lines in FIG. 1, i.e., in such a state that the discharge side of the compressor 21 is connected to the gas side of the user-side heat exchangers 52 and the intake side of the compressor 21 is connected to the gas side of the heat-source-side heat exchanger 24. The user-side expansion valves 51 are fully open and the heat-source-side expansion valve 25 is adjusted to an opening that reduces the pressure of the refrigerant. The main opening/closing device 34 is opened and the inlet opening/closing device 32*a* is closed such that the contaminant collecting device 27 is not used.

When the main refrigerant circuit in this state and the fan (not shown) of the heat source unit 2, the fans (not shown) of the user units 5, and the compressor 21 are started, the refrigerant gas drawn into the compressor 21 is compressed and sent to the oil separator 22, where the oil is separated by vapor-liquid separation. This compressed gaseous refrigerant passes through the four-way selector valve 23 and the gaseous refrigerant pipe 7 and flows into the user units 5. At the user units 5, the gaseous refrigerant is condensed by exchanging heat with the air inside the room by means of the user-side heat exchangers 52. This condensed liquid refrigerant passes through the user-side expansion valves 51 and the liquid refrigerant pipe 6 and flows to the heat source units 2. At the heat source unit 2, the pressure of the liquid refrigerant is reduced by the heat-source-side expansion valve 25 and then the liquid refrigerant is evaporated by exchanging heat with the outside air in the heat-source-side heat exchanger 24. This evaporated gaseous refrigerant passes through the four-way selector valve 23 and the main opening/closing device 34 and is again drawn into the compressor 21. In this way, the system operates in heating mode.

[3] Pipe Cleaning Mode (Gas Cleaning)

Now, pipe cleaning mode (gas cleaning) will be explained. The air conditioning system 1 of this embodiment replaces only the heat source unit 2 and the user units 5 while reusing the existing liquid refrigerant piping and gaseous refrigerant piping as the liquid refrigerant pipe 6 and the gaseous refrigerant pipe 7. Consequently, after the installation work is completed, debris, oil, and CFC or HCFC based refrigerant oil that remain as contaminants in the gaseous refrigerant pipe 6 and liquid refrigerant pipe 7 must be removed from the main refrigerant circuit before running the system in a normal operating mode. The pipe cleaning mode (gas cleaning) discussed here involves cleaning the entire refrigerant circuit of the air conditioning system 1 with an HFC or HC based refrigerant gas and using the contaminant collecting device 27 to collect the contaminants in the refrigerant circuit.

First, in step S1, the existing user units and heat source unit are removed and the new user units 5 and heat source unit 2 are installed and connected to the existing liquid refrigerant pipe 6 and gaseous refrigerant pipe 7 to form the main refrigerant circuit of the air conditioning device 1. Then, the main refrigerant circuit is pulled to a vacuum to remove the air inside and the main refrigerant circuit is charged with a new refrigerant. In step S2, the system is put into such a state that the contaminant collecting device 27 is used (contaminant collecting device ON). That is, the main opening/closing device 34 is closed and the inlet opening/closing device 32*a* is opened to configure the circuit such that the gaseous refrigerant is directed into the contaminant collecting container 31 when the system is run.

In step S3, the system is run in the same manner as in the previously described cooling mode. Since the circuit was configured to use the contaminant collecting device 27 in step S2, the gaseous refrigerant flowing through the intake gas pipe 35 passes through the contaminant collecting device 27 before being drawn into the compressor 21. Consequently, the gaseous refrigerant flows into the contaminant collecting device 27 together with debris that remained in various places throughout the main refrigerant circuit and residual oil for the previously used refrigerant that remained in the liquid refrigerant pipe 6 and the gaseous refrigerant pipe 7. As shown in FIG. 2, the contaminant-containing gaseous refrigerant passes through the inlet pipe 32 and is guided by the guide pipe 31*a* to the bottom of the contaminant collecting container 31. The contaminants in the gaseous refrigerant collect in the bottom of the contaminant collecting container 31 and only the decontaminated gaseous refrigerant is drawn through the outlet pipe 33 and into the compressor 21.

In step S4, the system runs in cooling mode until a prescribed amount of time has elapsed before proceeding to step S5. The prescribed amount of time is set to the time required to remove the contaminants from the main refrigerant circuit.

In step S5, the system is put into such a state that the contaminant collecting device 27 is not used (contaminant collecting device OFF). That is, the main opening/closing device 34 is opened and the inlet opening/closing device 32*a* is closed to configure the circuit such that the gaseous refrigerant bypasses the contaminant collecting container 31 (normal operation state).

In this way, pipe cleaning mode (gas cleaning) is executed according to the steps just described.

[4] Pipe Cleaning Mode (Liquid Cleaning)

Now, pipe cleaning mode (liquid cleaning) will be explained. In the previously described pipe cleaning mode (gas cleaning), the refrigerant flowing through the gaseous refrigerant circuit 12 is in a gaseous state and, thus, the gaseous refrigerant pipe 7 is cleaned by the gaseous refrigerant. The pipe cleaning mode (liquid cleaning) discussed here involves adjusting the opening of the user-side expansion valves 51 such that the refrigerant flowing through the gaseous refrigerant circuit 12 is in a wet state (gas-liquid two-phases) and cleaning the piping with the refrigerant in said wet state.

First, in step S11, the existing user units and heat source unit are removed and the new user units 5 and heat source unit 2 are installed and connected to the existing liquid refrigerant pipe 6 and gaseous refrigerant pipe 7 to form the refrigerant circuit of the air conditioning device 1. Then, the main refrigerant circuit is pulled to a vacuum to remove the air inside and the main refrigerant circuit is charged with a new refrigerant.

In step S12, the system is put into such a state that the contaminant collecting device 27 is used (contaminant collecting device ON). That is, the main opening/closing device 34 is closed and the inlet opening/closing device 32*a* is opened to configure the circuit such that the gaseous refrigerant is directed into the contaminant collecting container 31 when the system is run.

In step S13, the system is run in cooling mode in the same manner as in the case of gas cleaning.

In step S14, the system runs in cooling mode until a prescribed amount of time (first cooling time) has elapsed before proceeding to step S15.

In step S15, the openings of the user-side expansion valves 51 are increased to a larger opening than during the cooling mode operation of step S13 so that the pressure of the pressure-reduced refrigerant is increased to a pressure close to the saturation pressure and the refrigerant enters a wet state (gas-liquid two-phases) (wet cooling mode). Since the refrigerant flowing through the gaseous refrigerant circuit 12 is in a wet state, liquid refrigerant flows in the contaminant collecting container 31 along with the contaminants. As a result, the contaminants and liquid refrigerant accumulate in the bottom of the contaminant collecting container 31 and only the gaseous refrigerant separated from the contaminants and liquid refrigerant exits through the outlet and is drawn into the compressor 21.

In step S16, the system runs in wet cooling mode until a prescribed amount of time (second cooling time) has elapsed before proceeding to step S17.

In step S17, the system is run again in the same cooling mode as in step S13. That is, the openings of the user-side expansion valves 51 are decreased to approximately the same opening as during the cooling mode operation of step S13 so that the pressure of the pressure-reduced refrigerant is decreased to a pressure below the saturation pressure and the refrigerant enters a dry state (only gaseous refrigerant). When this is done, the liquid refrigerant accumulated in the contaminant collecting container 31 evaporates again and is drawn into the compressor 21 while only the contaminants remain in the contaminant collecting container 31.

In step S18, the system runs in cooling mode until a prescribed amount of time (third cooling time) has elapsed before proceeding to step S19. The total of the first, second, and third cooling times is set to the time required to remove the contaminants from the refrigerant circuit.

In step S19, the system is put into such a state that the contaminant collecting device 27 is not used (contaminant collecting device OFF). That is, the main opening/closing device 34 is opened and the inlet opening/closing device 32*a* is closed to configure the circuit such that the gaseous refrigerant bypasses the contaminant collecting container 31 (normal operation state).

In this way, pipe cleaning mode (liquid cleaning) is executed according to the steps just described.

(4) Characteristic Features of the Air Conditioning System

The air conditioning system 1 in accordance with this embodiment has the following characteristic features.

[1]

With the air conditioning system 1 of this embodiment, as shown in FIGS. 1 and 2, after the refrigeration apparatus is installed, the main opening/closing device 34 is operated such that refrigerant will pass through the contaminant collecting container 31 and the system is operated in the pipe cleaning modes described above. As a result, both refrigerant and contaminants remaining in the main refrigerant circuit are directed into the contaminant collecting container 31 and only the contaminants are separated and collected. The refrigerant from which the contaminants have been removed is then returned from the contaminant collecting container 31 to the intake gas pipe 35 (gaseous refrigerant pipe 12) through the outlet pipe 33. As a result, the refrigerant that is drawn into the compressor 21 downstream of the contaminant collecting container 31 is refrigerant from which the contaminants have been removed and it is more difficult for contaminants to be drawn into the compressor 21.

After pipe cleaning mode is completed, the main opening/closing device 34 is operated such that the refrigerant does not pass through the contaminant collecting container 31 and the system is run in a normal operation mode. When this is done, there is the possibility that contaminants will have accumulated in the inlet pipe 32 and outlet pipe 33 during pipe cleaning mode. However, since the inlet pipe 32 and outlet pipe 33 are provided with the return preventing shapes 32*b*, 33*b* such that contaminants cannot return to the intake gas pipe 35, the possibility that contaminants accumulated in the inlet pipe 32 will return to the intake gas pipe 35 can be reduced. As a result, even after the circuit configuration is changed, contaminants can be prevented from being drawn into the compressor 21 installed downstream and the reliability of the system can be improved from the standpoint of pipe cleaning mode.

Also, the structure is simple because the return preventing shapes 32*b*, 33*b* formed in the inlet pipe 32 and outlet pipe 33 are bends formed in the vicinity of the portions where the inlet pipe 32 and outlet pipe 33 branch from the intake gas pipe 35. Furthermore, since the portion of the intake gas pipe 35 in the vicinity of where the inlet pipe 32 and outlet pipe 33 branch therefrom is formed such that it slopes upward toward the compressor 21, the possibility that contaminants will be drawn into the compressor 21 can be reduced even further.

[2]

With the air conditioning system 1 of this embodiment, after the system has been run in pipe cleaning mode, the main opening/closing device 34 is operated such that the refrigerant will not pass through the contaminant collecting container 31 and the system is operated in a normal operation mode. However, some liquid refrigerant may have accumulated in the contaminant collecting container 31 along with the collected contaminants. Particularly in the case of pipe cleaning mode (liquid cleaning), if the cooling mode operation of step S17 shown in FIG. 4 is insufficient, liquid refrigerant may remain in the contaminant collecting container. However, since the air conditioning system 1 of this embodiment includes a non-return device 33*a* provided in the outlet pipe 33, gaseous refrigerant that has evaporated inside the contaminant collecting container 31 can be returned to the intake gas pipe 35 even during normal operation. Thus, loss of the refrigerant charged in the main refrigerant circuit can be reduced and overpressuring of the contaminant collecting container 31 can be prevented. As a result, the reliability of the system can be improved from the standpoint of pipe cleaning mode.

[3]

With the air conditioning system 1 of this embodiment, the contaminants in the refrigerant directed through the inlet pipe 32 are collected in the bottom of the contaminant collecting container 31 because the inlet and outlet of the container are provided on the top of the container. As a result, the possibility of the collected contaminants returning to the intake gas pipe 35 through the outlet can be reduced and the reliability of the system can be improved from the standpoint of pipe cleaning mode. Additionally, since the contaminant collecting container 31 is provided with the guide pipe 31*a* that extends from the top of the container to the bottom of the container and serves to guide the refrigerant flowing in through the inlet to the bottom of the container, the contaminant-containing refrigerant that flows into the contaminant collecting container through the inlet is guided to the bottom of the container by the guide pipe and the flow of refrigerant is prevented from short-circuiting from the inlet directly to the outlet. As a result, the possibility of the collected contaminants returning to the intake gas pipe 35 can be reduced.

Also, since the contaminant collecting container 31 is made of stainless steel, copper, a copper alloy, or another corrosion resistant material, the contaminant collecting container 31 is protected from corrosion caused by corrosive components among the contaminants.

(5) First Variation of the Contaminant Collecting Device

Figure 5:
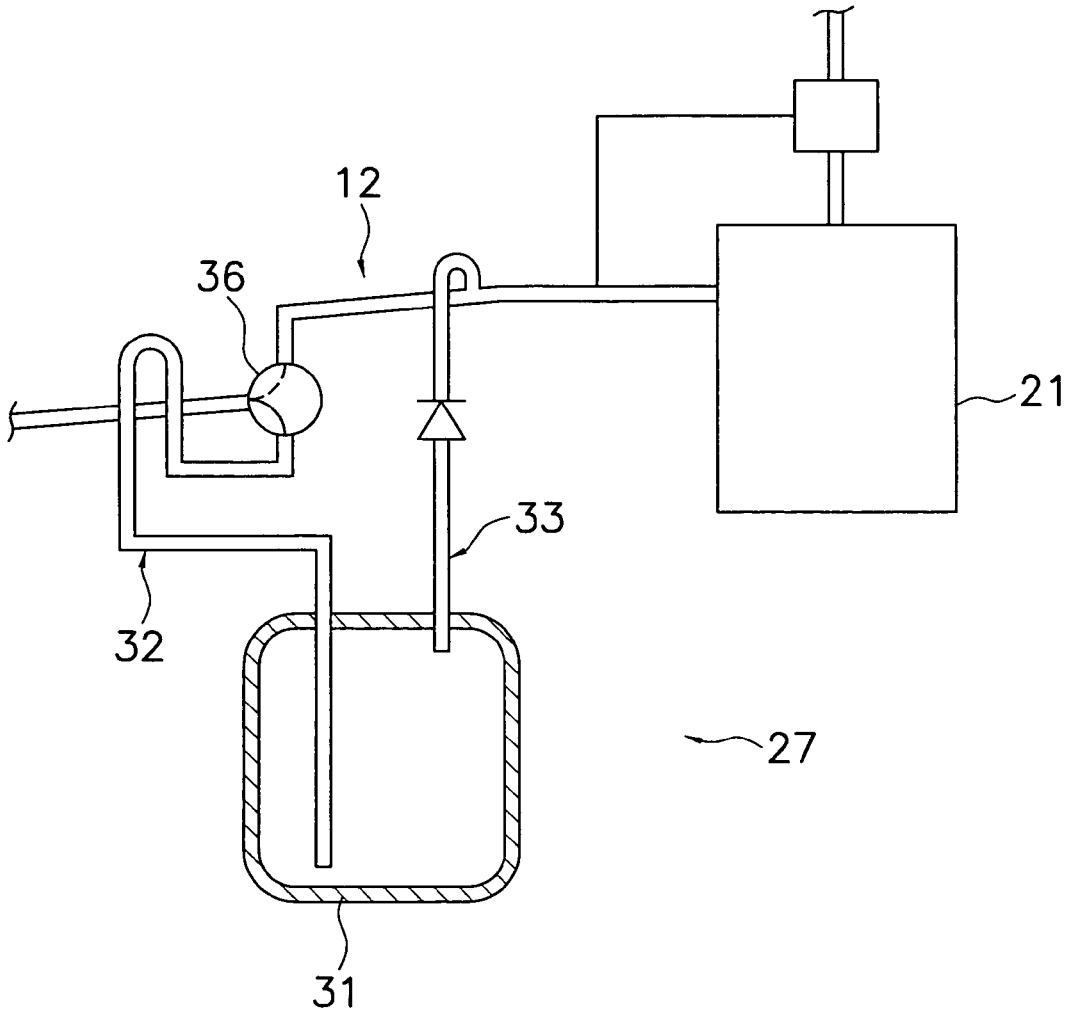
FIG. 5 is an enlarged partial view showing a first variation of the contaminant collecting device (the contaminant collecting container is shown as a cross section) of the first embodiment.

As shown in FIG. 5, it is acceptable to modify the contaminant collecting device 27 of this embodiment by replacing the main opening/closing device 34 with a three-way valve 36 that also performs the function of the inlet opening/closing device 32*a*. This arrangement reduces the number of component parts of the contaminant collecting device 27.

(6) Second Variation of the Contaminant Collecting Device

Figure 6:
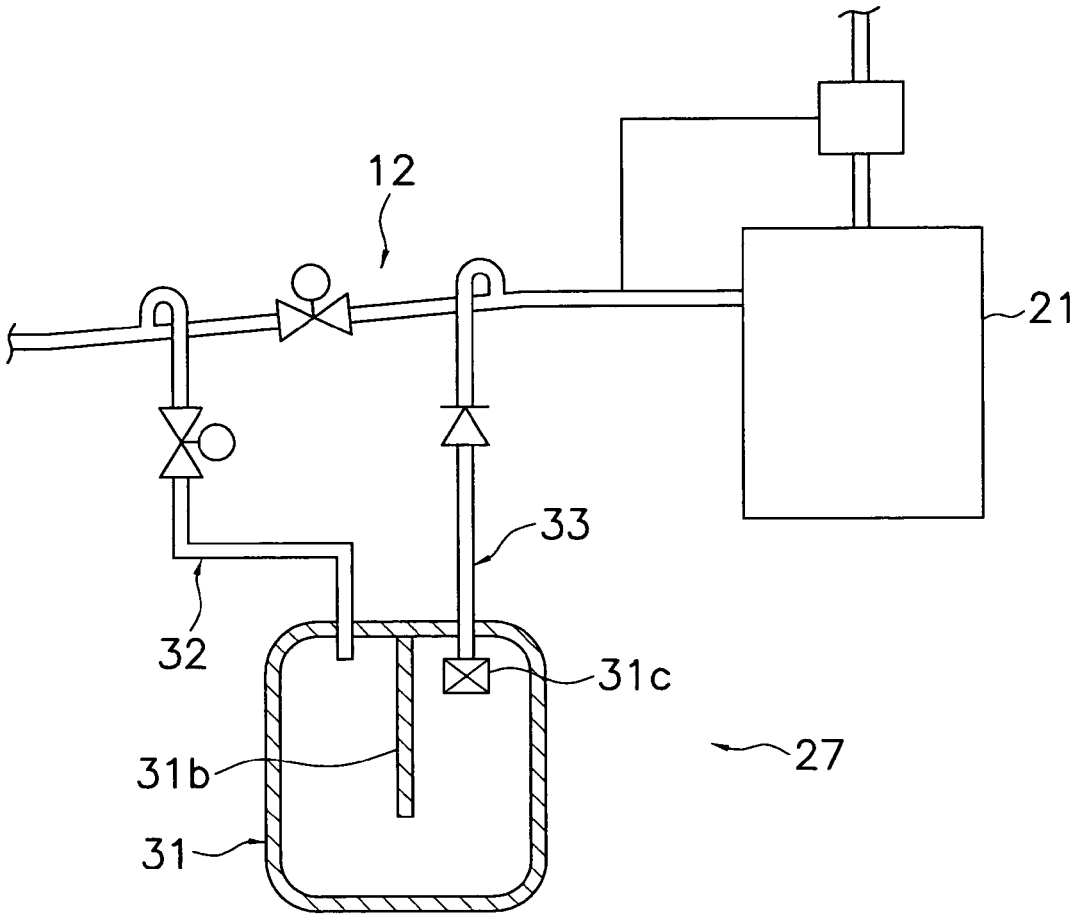
FIG. 6 is an enlarged partial view showing a second variation of the contaminant collecting device (the contaminant collecting container is shown as a cross section) of the first embodiment.

As shown in FIG. 6, it is also acceptable to modify the contaminant collecting device 27 of this embodiment by replacing the guide pipe 31*a* provided the contaminant collecting container 31 with a partitioning plate 31*b* that separates the space in the vicinity of the inlet from the space in the vicinity of the outlet. Additionally, a filter 31*c* might be provided in the outlet of the contaminant collecting container 31. This arrangement provides the same effects as providing a guide pipe 31*a*.

(7) Third Variation of the Contaminant Collecting Device

Figure 7:
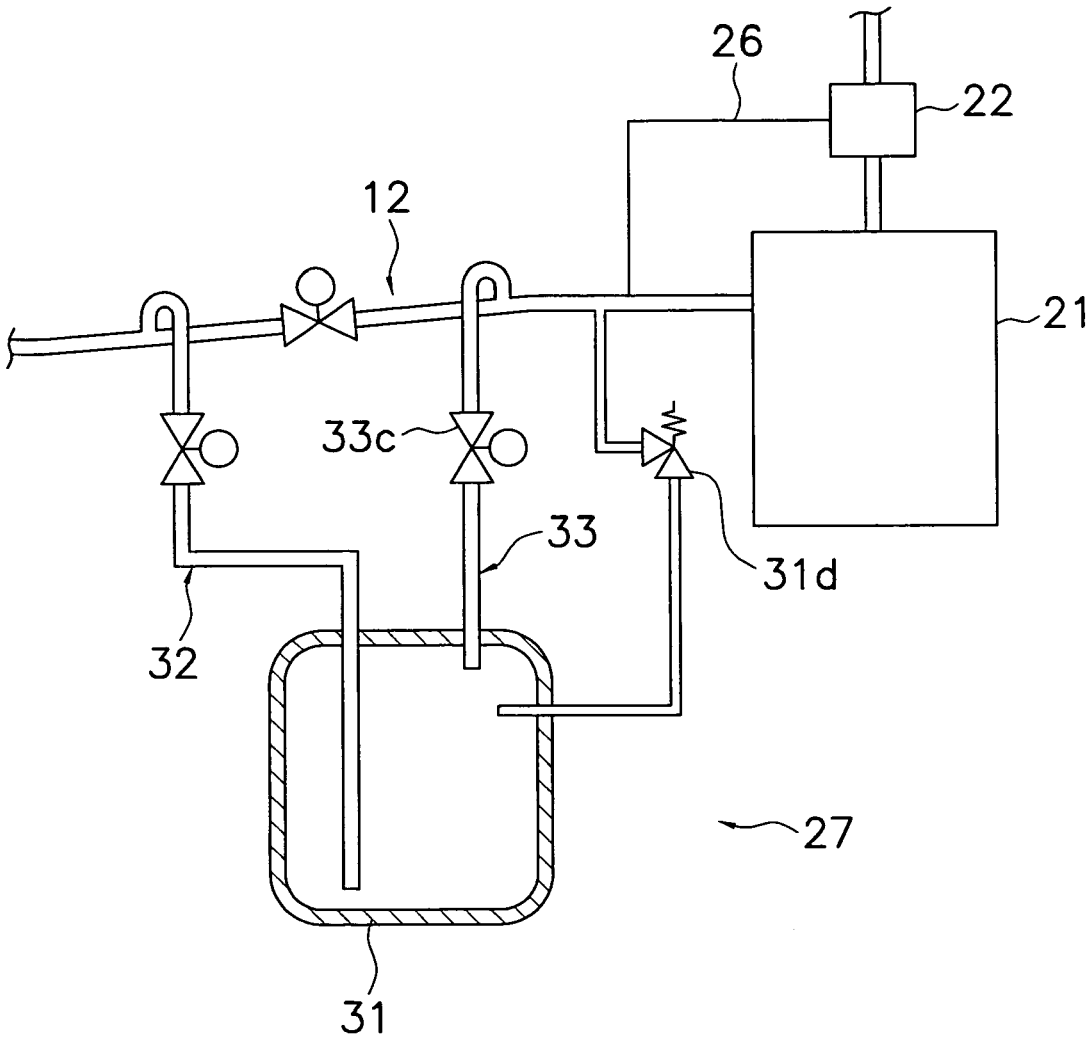
FIG. 7 is an enlarged partial view showing a third variation of the contaminant collecting device (the contaminant collecting container is shown as a cross section) of the first embodiment.

As shown in FIG. 7, it is also acceptable to modify the contaminant collecting device 27 of this embodiment by replacing the non-return device 33*a* provided in the outlet pipe 33 with an outlet opening/closing device 33*c* (solenoid valve) provided in the outlet pipe 33 and a pressure relief device 31*d* (pressure reducing valve) provided on top of the contaminant collecting container 31. This arrangement provides the same effects as providing the non-return device 33*a*.

(8) Fourth Variation of the Contaminant Collecting Device

Figure 8:
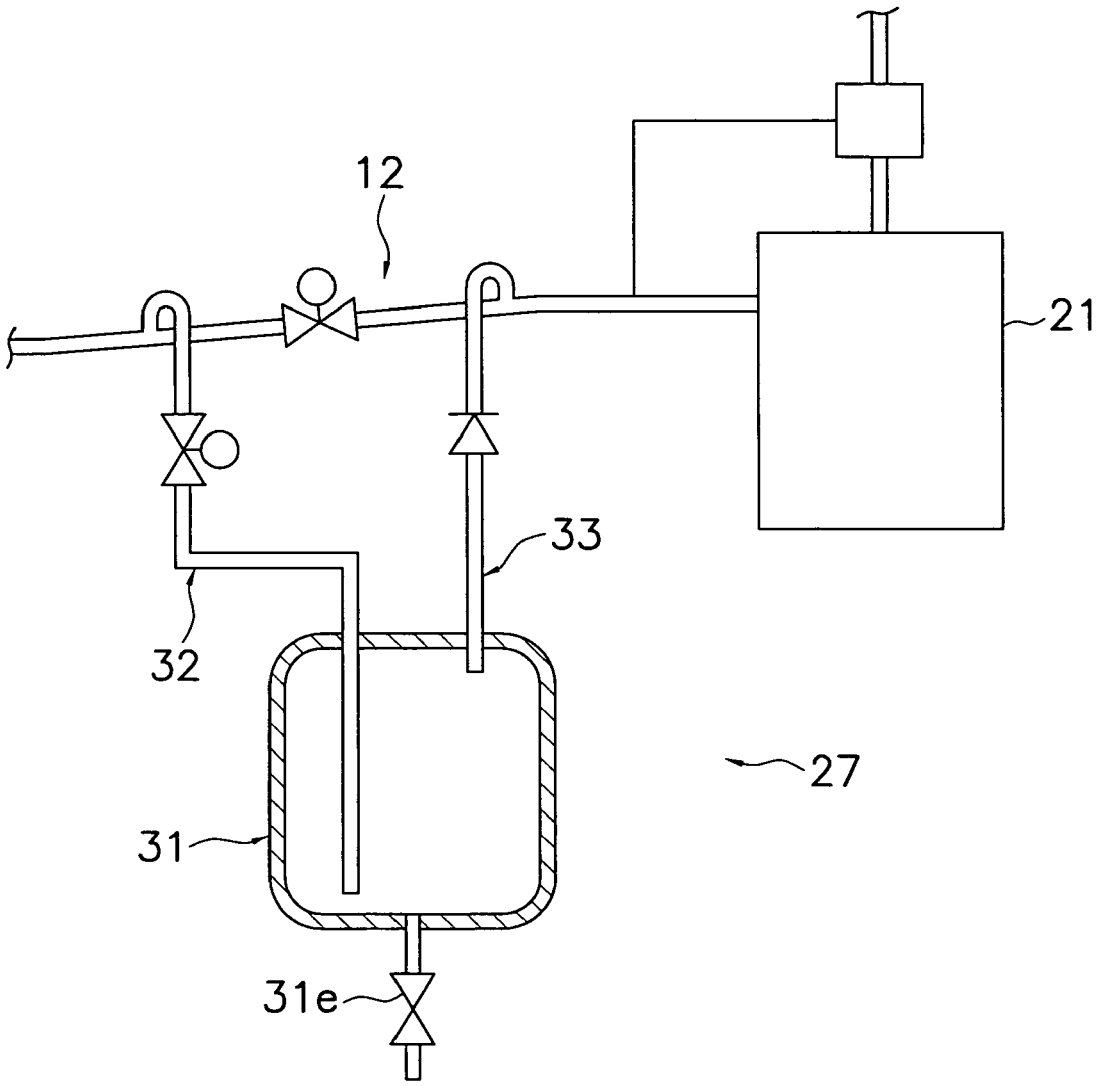
FIG. 8 is an enlarged partial view showing a fourth variation of the contaminant collecting device (the contaminant collecting container is shown as a cross section) of the first embodiment.

As shown in FIG. 8, it is also acceptable to modify the contaminant collecting device 27 of this embodiment by providing on the bottom of the contaminant collecting container 31*a* removal device 31*e* for removing collected contaminants to the outside. More specifically, the removal device 31*e* includes a drain pipe and a gate valve. This arrangement enables collected contaminants to be removed after the system is run in pipe cleaning mode.

(9) Fifth Variation of the Contaminant Collecting Device

Figure 9:
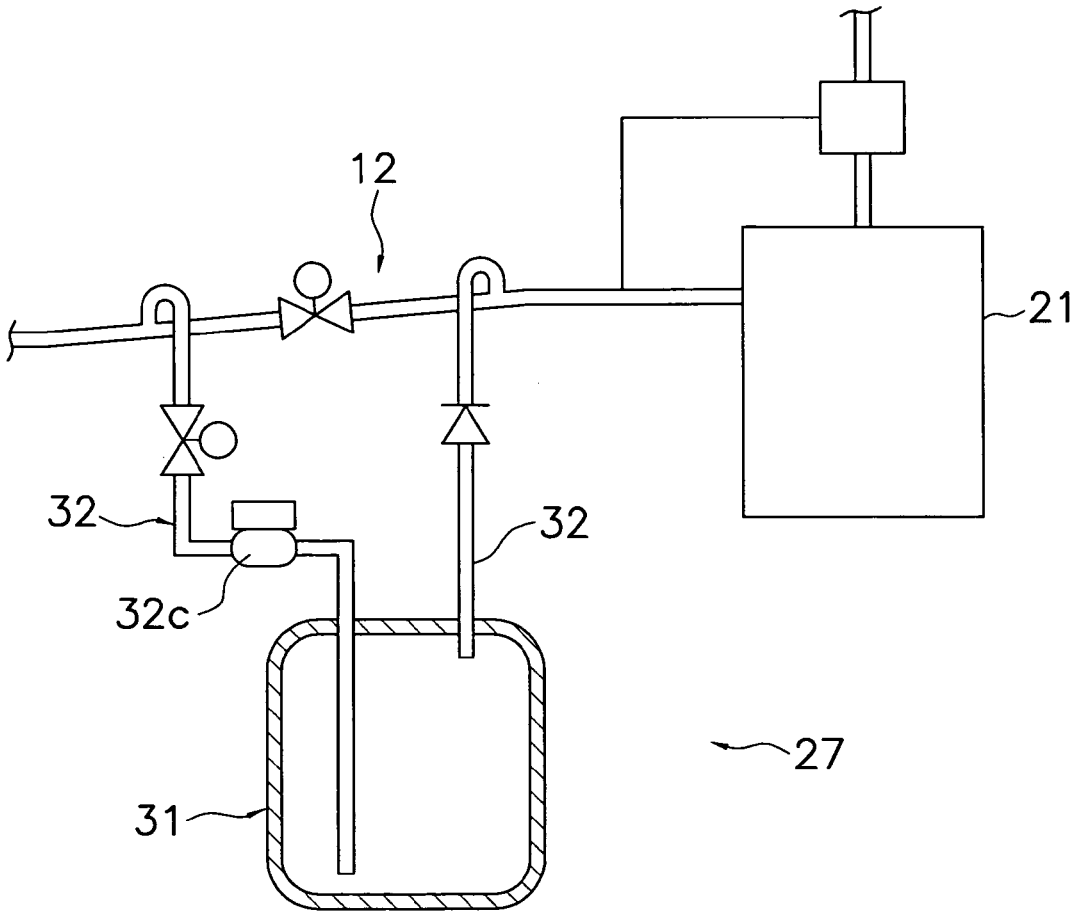
FIG. 9 is an enlarged partial view showing a fifth variation of the contaminant collecting device (the contaminant collecting container is shown as a cross section) of the first embodiment.

As shown in FIG. 9, it is also acceptable to modify the contaminant collecting device 27 of this embodiment by providing in the inlet pipe 32 an oil detecting device 32*c* for detecting oil among the contaminants. Although it is not shown in detail in the drawings, the oil detecting device 32*c* might comprise, for example, a sight glass provided on the inlet pipe 32, an ultraviolet light shining device provided on the sight glass, and a fluorescent light sensor configured to detect the presence of oil in the refrigerant flowing into the contaminant collecting container 31 by means of the ultraviolet light. By providing this kind of oil detecting device 32*c*, the pipe cleaning mode can be ended when oil is no longer detected. As a result, the contaminants can be removed from the main refrigerant circuit with certainty.

(10) Sixth Variation of the Contaminant Collecting Device

Figure 10:
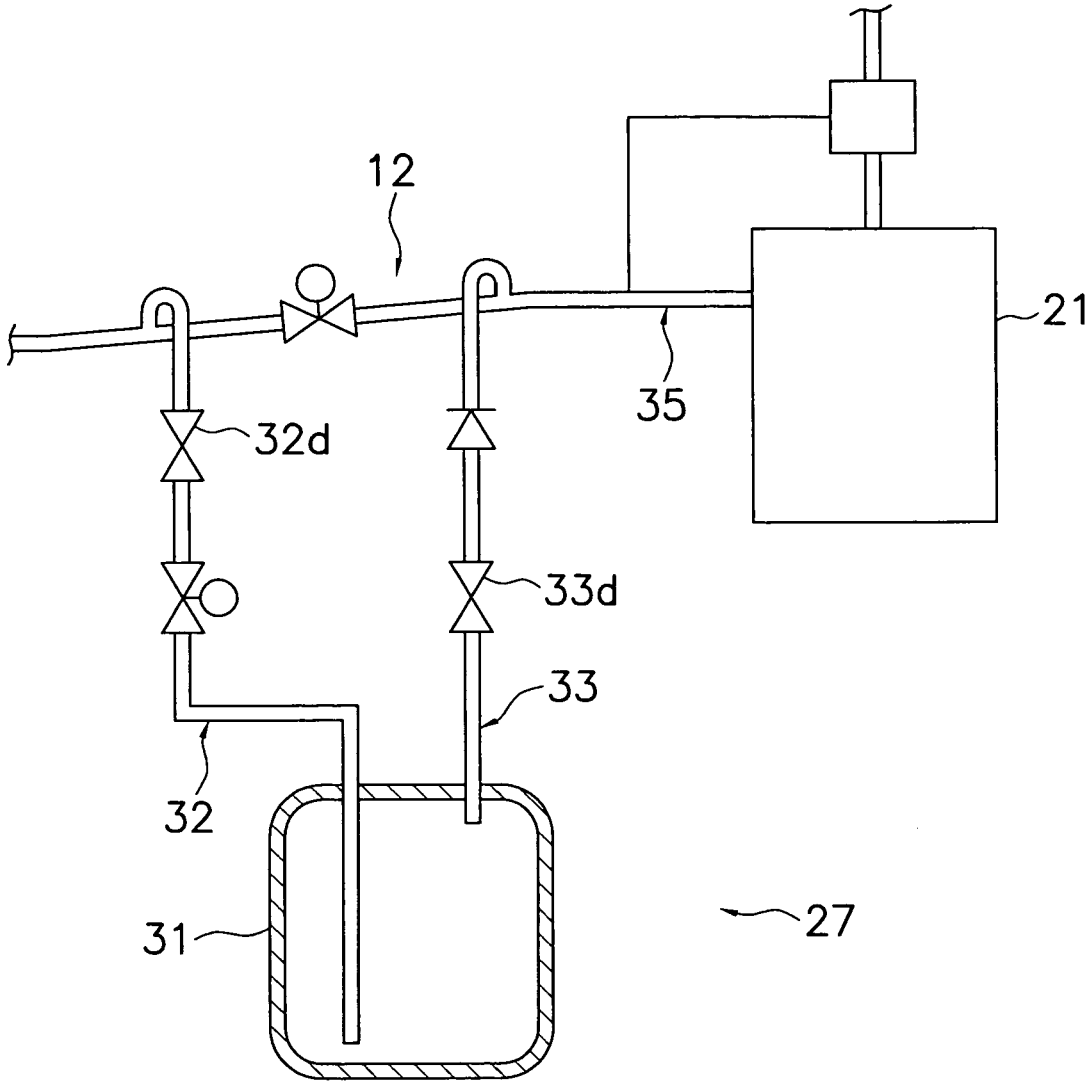
FIG. 10 is an enlarged partial view showing a sixth variation of the contaminant collecting device (the contaminant collecting container is shown as a cross section) of the first embodiment.

As shown in FIG. 10, it is also acceptable to modify the contaminant collecting device 27 of this embodiment by providing gate valves 32*d*, 33*d* in the inlet pipe 32 and outlet pipe 33 so that the contaminant collecting container 31 can be isolated from the intake gas pipe 35. This arrangement enables collected contaminants to be removed from the system together with the entire contaminant collecting container 31.

Figure 11:
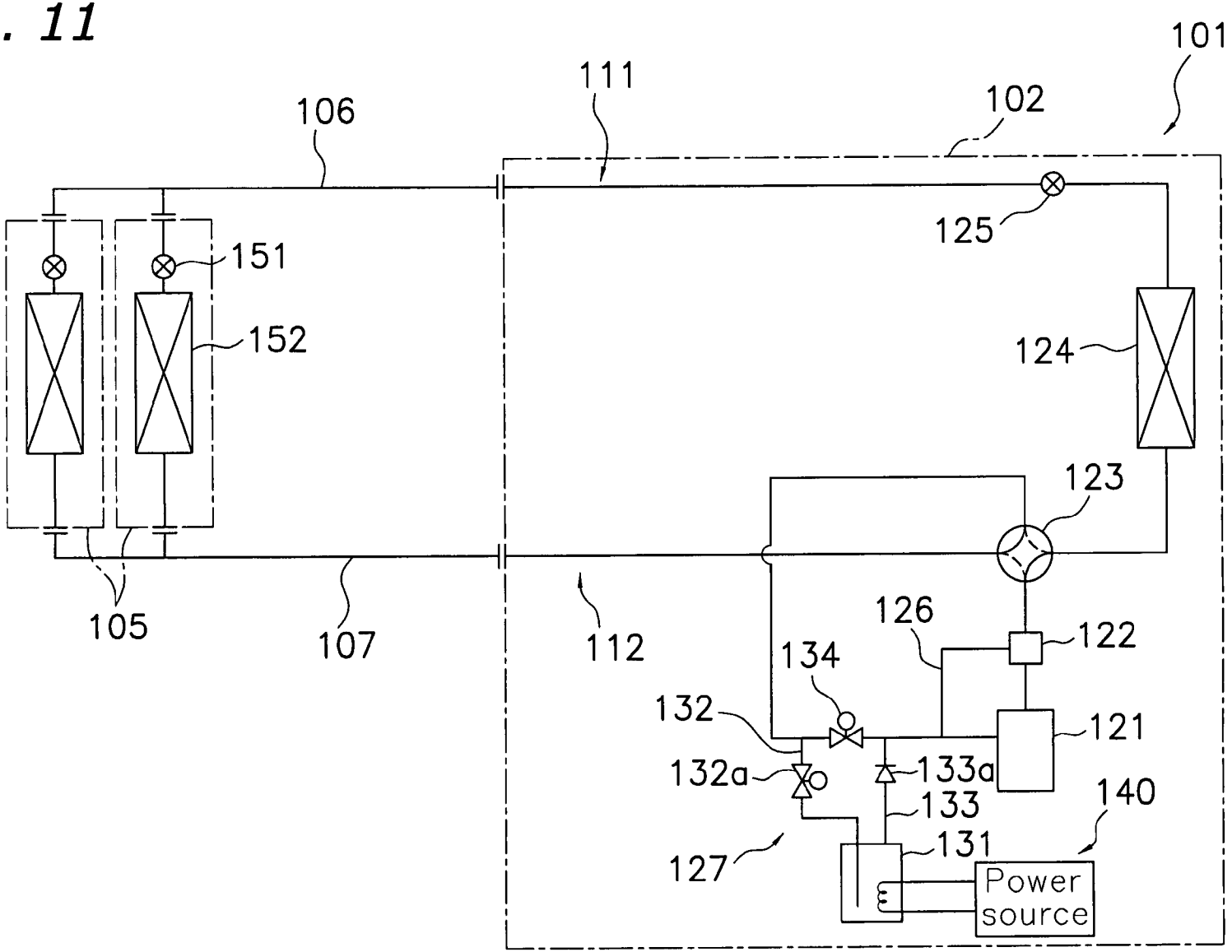
FIG. 11 is a schematic view of the refrigerant circuit of an air conditioning system in accordance with a second embodiment of the present invention.

SECOND EMBODIMENT (1) Constituent Features of the Air Conditioning System and Contaminant Collecting Container FIG. 11 is a schematic view of the refrigerant circuit of an air conditioning system 101 in accordance with a second embodiment exemplifying a refrigeration apparatus in accordance with the present invention. The air conditioning system 101 has basically the same constituent features as the air conditioning system 1 of the first embodiment except that it is provided with a heating device 140 configured such that it can heat the inside of a contaminant collecting container 131 of a contaminant collecting device 127. In the following explanation of the air conditioning system 101, descriptions of constituent features that are the same as the air conditioning system 1 of the first embodiment are omitted while differences with respect to the air conditioning system 1 of the first embodiment are described.

Similarly to the air conditioning system 1 of the first embodiment, the air conditioning system 101 is provided with a heat source unit 102 and user units 105 that use an HFC or HC based refrigerant and reuses the existing liquid refrigerant piping and gaseous refrigerant piping for a liquid refrigerant pipe 106 and a gaseous refrigerant pipe 107. Similarly to the user units 5 of the first embodiment, the user units 105 are each equipped chiefly with a user-side expansion valve 151 and a user-side heat exchanger 152. Similarly to the heat source unit 2 of the first embodiment, the heat source unit 102 is equipped chiefly with a compressor 121, an oil separator 122, a four-way selector valve 123, a heat-source-side heat exchanger 124, a heat-source-side expansion valve 125, and an oil return pipe 126. The liquid refrigerant pipe 106 connects the liquid sides of the user-side heat exchangers 152 of the user units 105 to the liquid side of the heat-source-side heat exchanger 124 of the heat source unit 102. The gaseous refrigerant pipe 107 connects the gas sides of the user-side heat exchangers 152 of the user units 105 to the four-way selector valve 123 of the heat source unit 102. The portion of the refrigerant circuit from the user-side heat exchangers 152 to the heat-source-side heat exchanger 124 that includes the user-side expansion valves 151, the liquid refrigerant pipe 106, and the heat-source-side expansion valve 125 is defined as the liquid refrigerant circuit 111.

Figure 12:
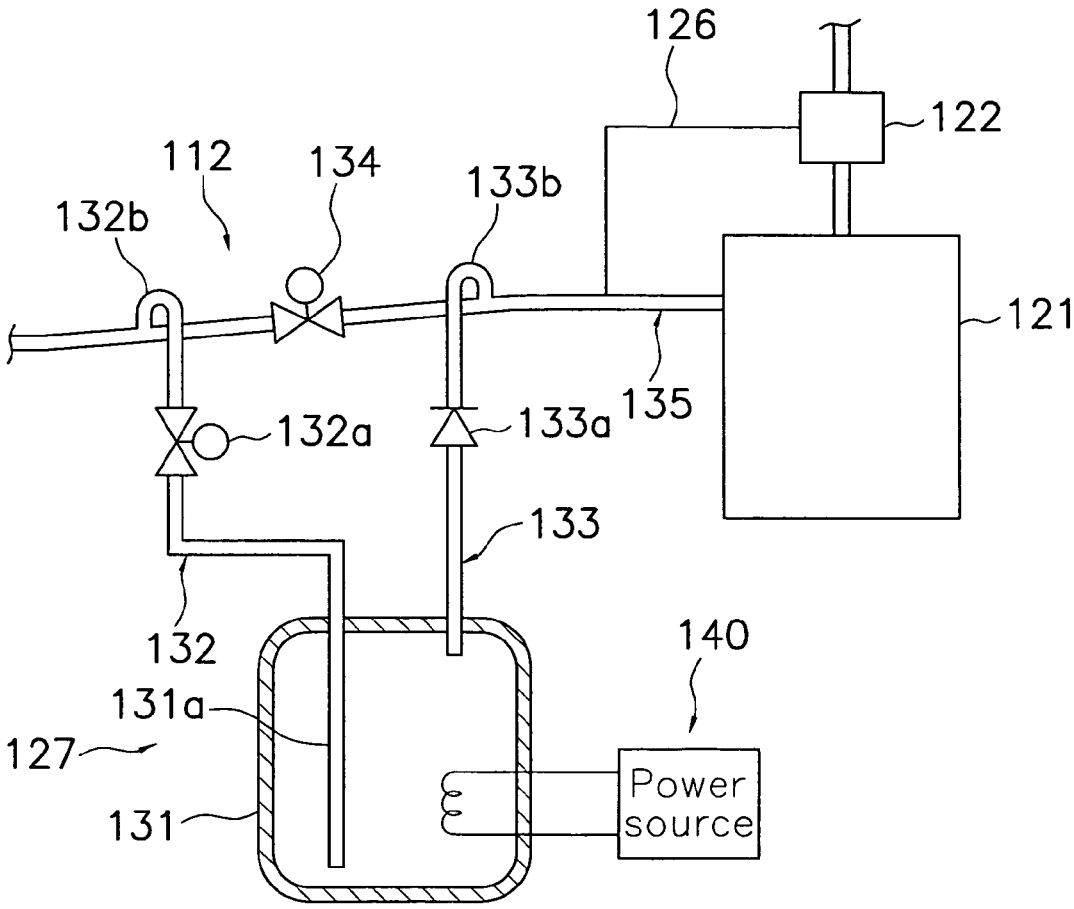
FIG. 12 is an enlarged partial view showing the vicinity of the contaminant collecting device (the contaminant collecting container is shown as a cross section) of the second embodiment.

As shown in FIG. 12, similarly to the air conditioning system 1 of the first embodiment, the air conditioning system 101 of this embodiment is further provided with a contaminant collecting device 127 installed in the gaseous refrigerant circuit 112. Similarly to the contaminant collecting device 27 of the air conditioning system 1 of the first embodiment, the contaminant collecting device 127 is provided with a contaminant collecting container 131 having an internal pipe 131*a*, an inlet pipe 132 including an inlet opening/closing device 132*a* and a return preventing shape 132*b*, an outlet pipe 133 including a non-return device 133*a* and a return preventing shape 133*b*, and a main opening/closing device 134. The contaminant collecting device 127 of this embodiment is also provided with a heating device 140 for heating the contaminant collecting container 131. In this embodiment, the heating device 140 is an electric heating unit, such as an immersion heater or a band heater.

(2) Operation of the Air Conditioning System

Figure 13:
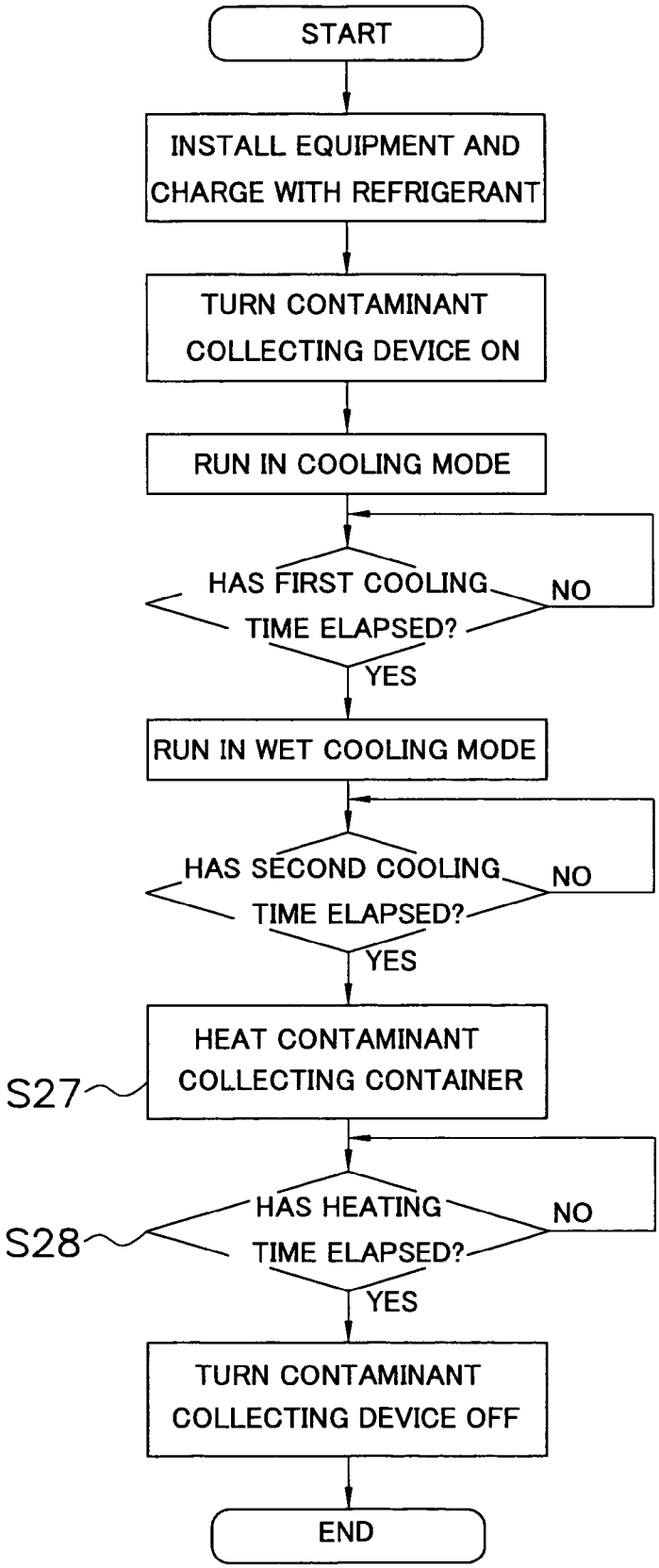
FIG. 13 is a flowchart for the pipe cleaning mode (heating after liquid cleaning) of the second embodiment.
Figure 14:
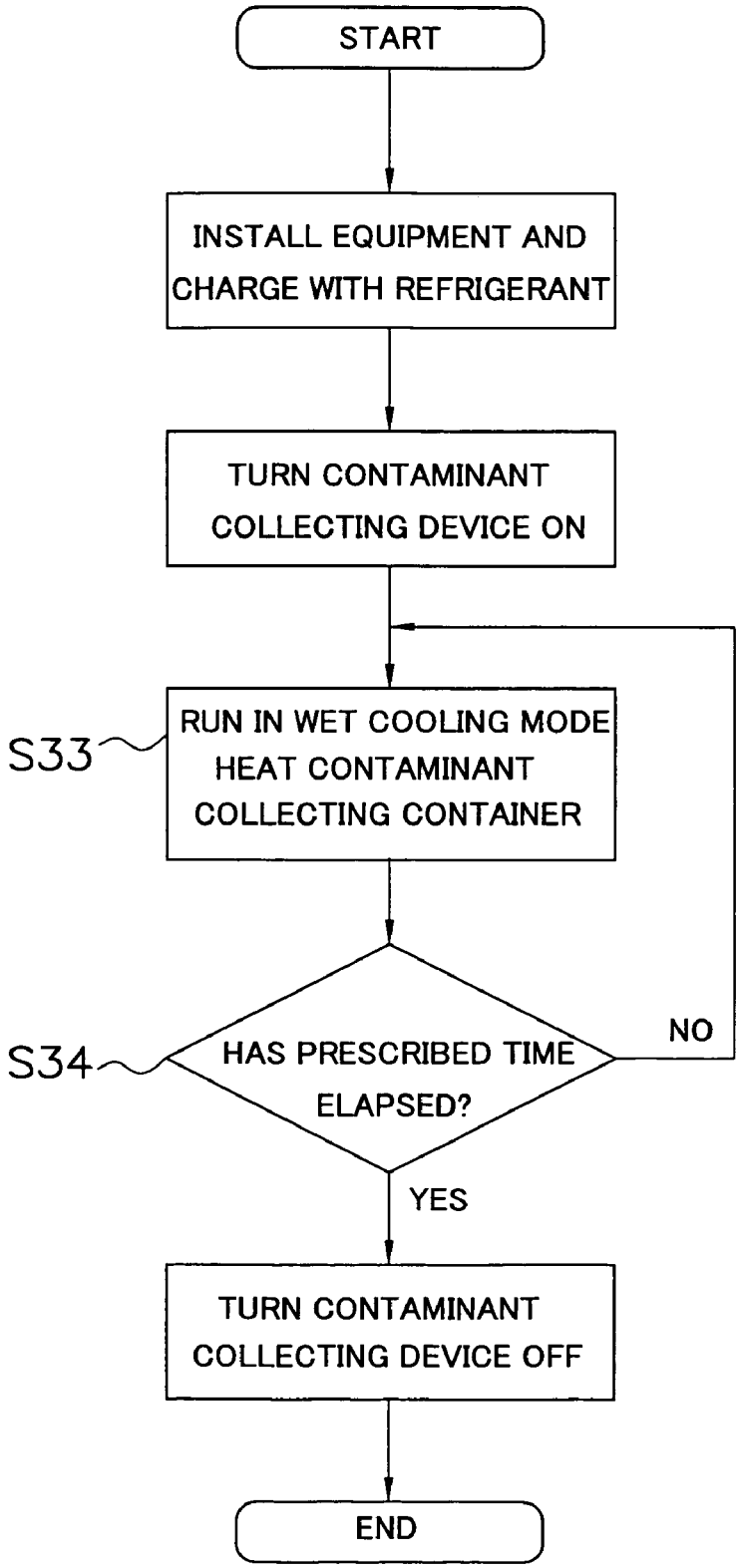
FIG. 14 is a flowchart for the pipe cleaning mode (heating during liquid cleaning) of the second embodiment.

The operation of the air conditioning system 101 will now be described using FIGS. 11, 13, and 14. FIG. 13 is a flowchart for operation in the pipe cleaning mode (heating after liquid cleaning). FIG. 14 is a flowchart for operation in the pipe cleaning mode (heating during liquid cleaning). In the following explanation, descriptions of operation in normal operation modes (cooling and heating mode) are omitted and only pipe cleaning mode is described.

[1] Pipe Cleaning Mode (Heating After Liquid Cleaning)

Now, pipe cleaning mode (heating after liquid cleaning) will be explained. As shown in FIG. 13, this pipe cleaning method differs from the pipe cleaning mode (liquid cleaning) of the first embodiment only in that the cooling mode steps S17, S18 (see FIG. 4) are changed to heating steps S27, S28 in which the contaminant collecting container 131 is heated by the heating device 140. This change enables the liquid refrigerant to be evaporated more quickly than in a case in which the liquid refrigerant is evaporated by running the system in cooling mode and the time required for completing pipe cleaning mode can be reduced.

[2] Pipe Cleaning Mode (Heating During Liquid Cleaning)

Now, pipe cleaning mode (heating during liquid cleaning) will be explained. As shown in FIG. 14, the pipe cleaning mode (heating during liquid cleaning) described here is a pipe cleaning method obtained by changing the cooling steps S3, S4 (see FIG. 3) of the pipe cleaning mode (gas cleaning) of the first embodiment to wet cooling mode steps S33, S34 and also evaporating the liquid refrigerant that have accumulated in the contaminant collecting container 131 using the heating device 140. With this arrangement, the time required for pipe cleaning mode to be completed is reduced because it is not necessary to evaporate the liquid refrigerant accumulated in the contaminant collecting container 131 after the system is operated in the wet cooling mode. Additionally, the decrease in the amount of refrigerant circulating through the refrigerant circuit during wet cooling mode can be held in check.

(3) Characteristic Features of the Air Conditioning System

The air conditioning system 101 in accordance with this embodiment has the following characteristic features.

[1]

With the air conditioning system 101 of the present invention, as in the previously described pipe cleaning mode, the liquid refrigerant that accumulates in the bottom of the contaminant collecting container 131 along with the contaminants can be evaporated with the heating device 140 and returned to the main refrigerant circuit either after the contaminants have been collected in the contaminant collecting container 131 or during collection of the contaminants. As a result, the system can be shifted to a normal operation mode quickly after pipe cleaning mode is completed and the reliability of the system can be improved from the standpoint of pipe cleaning mode.

Furthermore, with this pipe cleaning mode (heating during liquid cleaning), a sufficient quantity of circulating refrigerant can be maintained in the refrigerant circuit, even during wet cooling operation, because the liquid refrigerant can be prevented from accumulating inside the contaminant collecting container 131. It is also possible to reduce the capacity of the contaminant collecting container 131.

[2]

Since the heating device 140 of this embodiment is electric, the contaminant collecting container 131 can be heated regardless of the operating conditions of the air conditioning system 101. Also, since the heating device 140 is configured to heat the liquid refrigerant accumulated in the contaminant collecting container 131, it is easy to control.

(4) First Variation of the Heating Device

Figure 15:
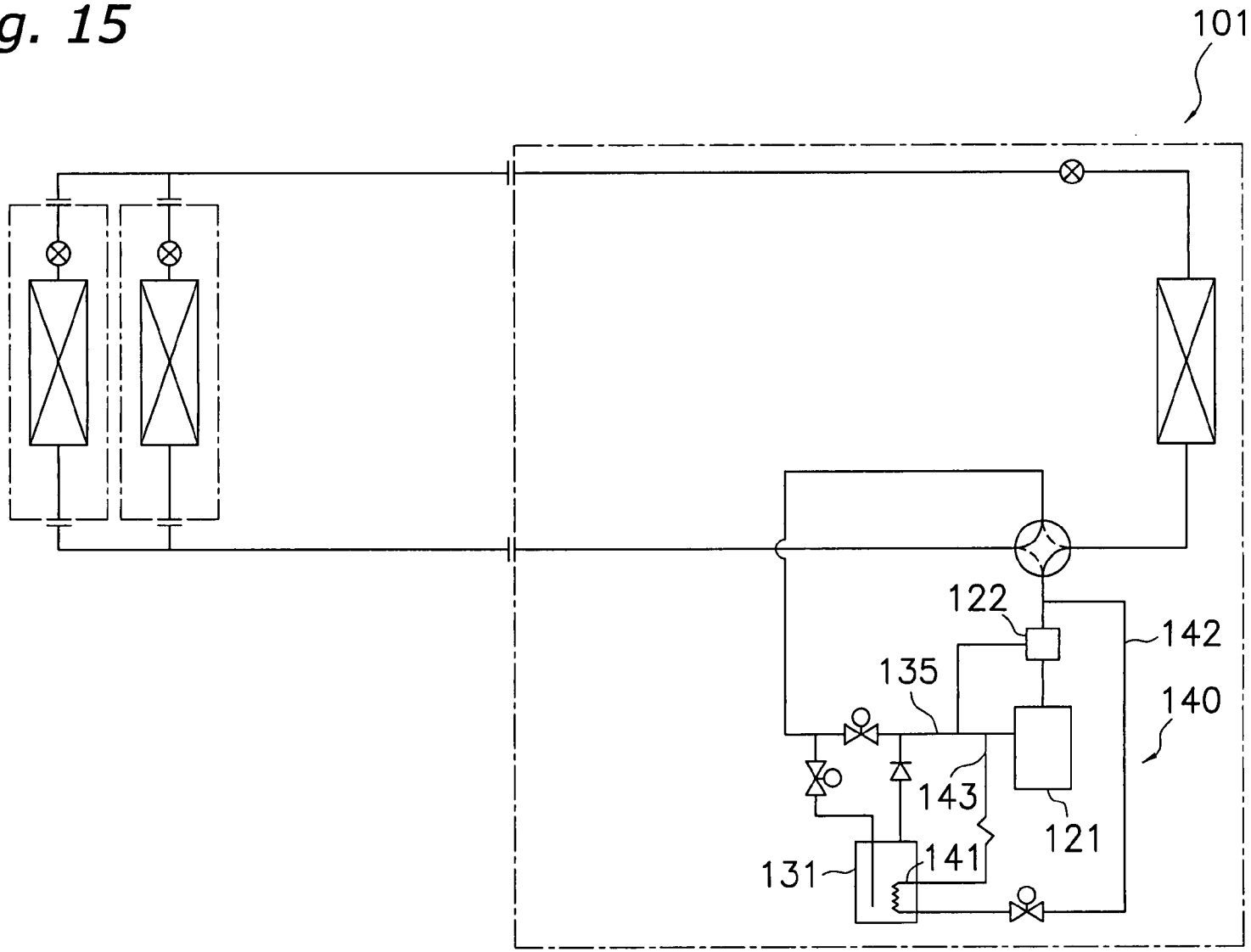
FIG. 15 is a schematic view of the refrigerant circuit of a first variation of the air conditioning system in accordance with the second embodiment of the present invention.

As shown in FIG. 15, it is acceptable to change the heating device 140 of the air conditioning system 101 of this embodiment by replacing the electric heating unit with a heat exchanger 141 that uses a portion of the gaseous refrigerant discharged from the compressor 121 as a heat source. In this variation, the heating device 140 is made up of the heat exchanger 141 provided in the contaminant collecting container 131, an inlet pipe 142 connecting the outlet of the oil separator 122 to the heat exchanger 141; and an outlet pipe 143 connecting the heat exchanger 141 to intake gas pipe 135 of the compressor 121. As a result, the heat of the comparatively high-temperature gaseous refrigerant discharged from the compressor 121 can be utilized effectively.

(5) Second Variation of the Heating Device

Figure 16:
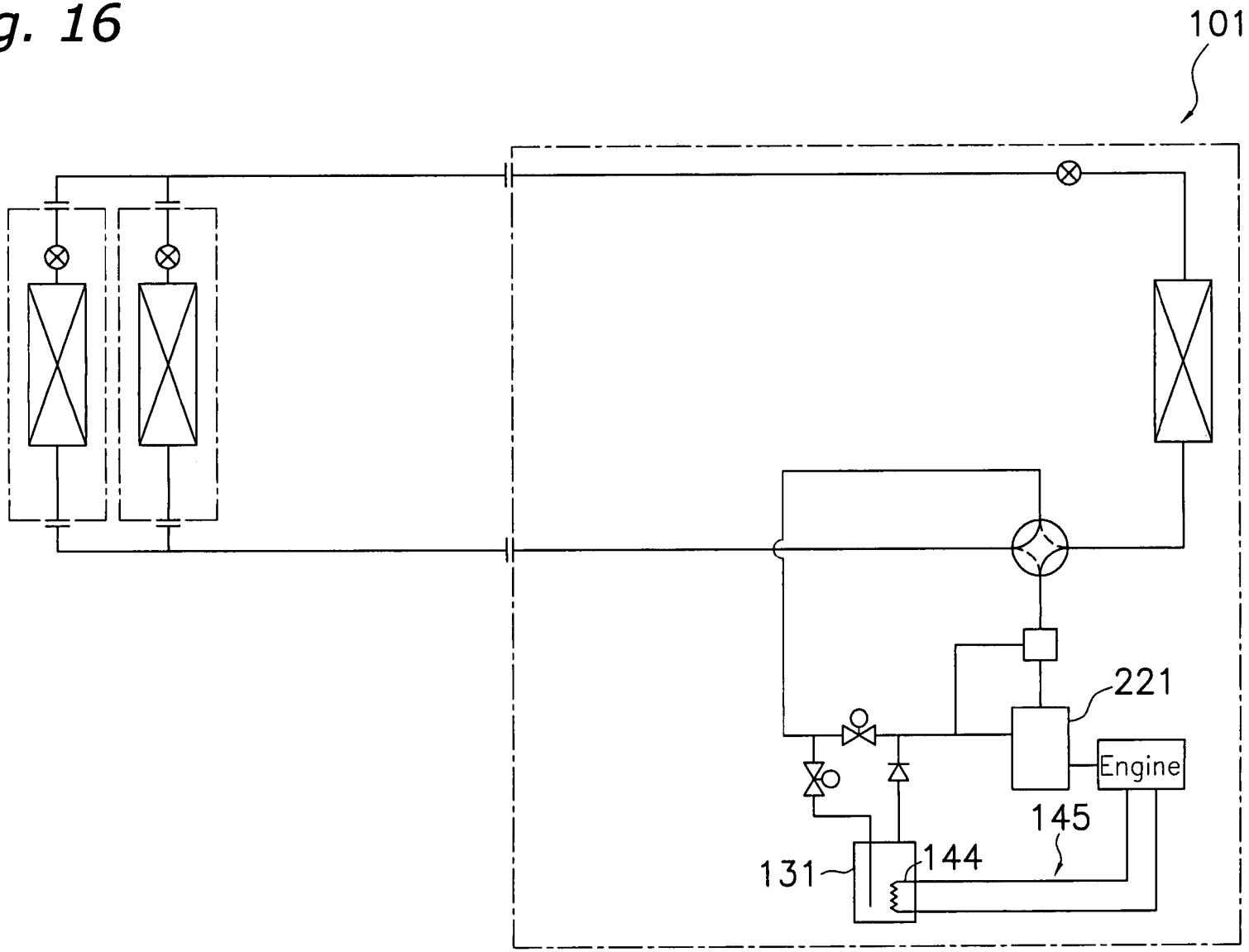
FIG. 16 is a schematic view of the refrigerant circuit of a second variation of the air conditioning system in accordance with the second embodiment of the present invention.

The compressor 121 of the air conditioning system 101 of this embodiment can be changed to compressor 221 that is driven by a gas engine or other engine instead of an electric motor. In such a case, the heating device 140 can be changed to have a heat exchanger 144 configured to use exhaust heat (external heat source) from the engine of the compressor 221, as shown in FIG. 16. In this variation, the heating device 140 is made up of a heat exchanger 144 provided in the contamination collecting container 131 and a heat medium circuit 145 for delivering water or other heat medium heated by exhaust heat of the engine of the compressor 221 to the heat exchanger 144. As a result, the exhaust heat of a gas engine can be utilized effectively.

OTHER EMBODIMENTS

Although embodiments of the present invention have been described herein with reference to the drawings, the specific constituent features are not limited to those of these embodiments and variations can be made within a scope that does not deviate from the gist of the invention.

[1] Although the previously described embodiments disclose applications of the present invention to an air conditioning system, it is acceptable to apply the present invention to other refrigeration apparatuses that are provided with a vapor compression type refrigerant circuit.

[2] Although the previously described embodiments disclose systems having one compressor, it is also acceptable to have a plurality of compressors. The type of compressor is also not limited by the previously described embodiments.

[3] Although the previously described embodiments disclose situations in which an existing air conditioning system that used a CFC or HCFC based refrigerant is replaced with an air conditioning system that uses an HFC or HC based refrigerant, the invention can also be applied to situations in which the existing system also used an HFC or HC based refrigerant. In such a situation, chiefly debris and oil remaining in the refrigerant circuit after the installation are removed from the main refrigerant circuit.

[4] Although in the previously described embodiments the contaminant collecting device is built into the heat source unit, the invention is not limited to this arrangement. It is also acceptable for the contaminant collecting device to be a unit that can be connected to the intake side of a compressor that is separate from the heat source unit.

[5] Although in the previously described embodiments the contaminant collecting container is made of a corrosion resistant material, it is also acceptable for the inside surface of the container to be treated with a corrosion resistant coating.

[6] Although the first embodiment discloses a method in which pipe cleaning mode (liquid cleaning) is accomplished by adjusting the opening of the user-side expansion valves, it is also acceptable to accomplish the same by controlling the fans of the user units.

[7] Although the second embodiment discloses several variations in which different heating devices are provided in the contaminant collecting container, it is also acceptable for the heating device to be a heat exchanger that heats using the liquid refrigerant flowing in the liquid refrigerant circuit.

APPLICABILITY TO INDUSTRY

By utilizing the present invention, it is possible to improve the reliability of refrigeration apparatuses provided with vapor compression type refrigerant circuits from the standpoint of the pipe cleaning mode.

The invention claimed is:

1. A refrigeration apparatus comprising:

a vapor compression type main refrigerant circuit including a compressor, a user-side heat exchanger, a heat-source-side heat exchanger, and a gaseous refrigerant circuit connecting the user-side heat exchanger and the compressor together;

a contaminant collecting container configured to separate contaminants from refrigerant flowing in the gaseous refrigerant circuit when the refrigerant is directed through the gaseous refrigerant circuit;

an inlet pipe branching from the gaseous refrigerant circuit to direct the refrigerant into the contaminant collecting container and connected to an inlet of the contaminant collecting container such that contaminants accumulated in the contaminant collecting container cannot return to the gaseous refrigerant circuit;

an outlet pipe branching from the gaseous refrigerant circuit at a position downstream of where the inlet pipe branches and connected to an outlet of the contaminant collecting container to return the refrigerant from which the contaminants have been separated by the contaminant collecting container to the gaseous refrigerant circuit; and a main opening/closing device configured to shut off the flow of the refrigerant between a part of the gaseous refrigerant circuit where the inlet pipe branches therefrom and part of the gaseous refrigerant circuit where the outlet pipe branches therefrom.

2. The refrigeration apparatus as recited in claim 1, wherein the inlet pipe includes a return preventing shape for preventing contaminants that have accumulated inside the inlet pipe from returning to the gaseous refrigerant circuit.

3. The refrigeration apparatus as recited in claim 2, wherein one of the inlet and outlet pipes includes a return preventing shape for preventing contaminants that have accumulated inside the outlet pipe from returning to the gaseous refrigerant circuit, the return preventing shape being a bend formed in a vicinity of a portion where at least one of the inlet and outlet pipes branches from the gaseous refrigerant circuit.

4. The refrigeration apparatus as recited in claim 1, wherein the outlet pipe is connected to the outlet of the contaminant collecting container such that contaminants that have accumulated inside the outlet pipe do not return to the gaseous refrigerant circuit.

5. The refrigeration apparatus as recited in claim 4, wherein the outlet pipe includes a return preventing shape for preventing contaminants that have accumulated inside the outlet pipe from returning to the gaseous refrigerant circuit.

6. The refrigeration apparatus as recited in claim 1, wherein a portion of the gaseous refrigerant circuit in a vicinity of where one of the inlet and outlet pipes branches therefrom is formed such that the portion of the gaseous refrigerant circuit slopes upward toward an intake side of the compressor.

7. The refrigeration apparatus as recited in claim 1, wherein the main opening/closing device is further arranged to shut off the flow of the refrigerant from the gaseous refrigerant circuit to the inlet pipe.

8. The refrigeration apparatus as recited in claim 1, wherein the inlet and the outlet of the contaminant collecting container are provided on a top of the contaminant collecting container.

9. The refrigeration apparatus as recited in claim 8, wherein the contaminant collecting container includes a guide pipe that extends from the top of the contaminant collecting container to a bottom of the contaminant collecting container and serves to guide the refrigerant that has entered through the inlet of the contaminant collecting container to the bottom of the contaminant collecting container.

10. The refrigeration apparatus as recited in claim 8, wherein a partitioning plate is provided inside the contaminant collecting container to separate a first space in a vicinity of the inlet of the contaminant collecting container and a second space in a vicinity of the outlet of the contaminant collecting container.

11. The refrigeration apparatus as recited in claim 8, wherein the outlet of the contaminant collecting container includes a filter.

12. The refrigeration apparatus as recited in claim 8, wherein the bottom of the contaminant collecting container includes a removal device configured to remove contaminants.

13. The refrigeration apparatus as recited in claim 8, wherein the top of the contaminant collecting container includes a pressure relief device for preventing overpressuring of the contaminant collecting container.

14. The refrigeration apparatus as recited in claim 1, wherein one of the inlet pipe and the inlet of the contaminant collecting container includes an oil detecting device for detecting oil among the contaminants.

15. The refrigeration apparatus as recited in claim 1, wherein the inside of the contaminant collecting container has an inside surface that is made of a corrosion resistant material or treated with a corrosion resistant coating to prevent corrosion caused by corrosive components among the contaminants.

16. The refrigeration apparatus as recited in claim 1, wherein the contaminant collecting container is connected to the gaseous refrigerant circuit such that the contaminant collecting container can be isolated the gaseous refrigerant circuit.

17. A refrigeration apparatus comprising:

a vapor compression type main refrigerant circuit including a compressor, a user-side heat exchanger, a heat-source-side heat exchanger, and a gaseous refrigerant circuit connecting the user-side heat exchanger and the compressor together;

a contaminant collecting container configured to separate contaminants from the refrigerant flowing in the gaseous refrigerant circuit when the refrigerant is directed through the gaseous refrigerant circuit;

an inlet pipe branching from the gaseous refrigerant circuit and connected to an inlet of the contaminant collecting container to direct refrigerant into the contaminant collecting container;

an outlet pipe branching from the gaseous refrigerant circuit at a position downstream of where the inlet pipe branches and connected to an outlet of the contaminant collecting container to return refrigerant from which the contaminants have been separated by the contaminant collecting container to the gaseous refrigerant circuit;

a main opening/closing device configured to shut off the flow of the refrigerant between a part of the gaseous refrigerant circuit where the inlet pipe branches therefrom and a part of the gaseous refrigerant circuit where the outlet pipe branches therefrom; and a heating device arranged to heat an inside area of the contaminant collecting container provided in the container.

18. The refrigeration apparatus as recited in claim 17, wherein the heating device is a heat exchanger that is arranged to use a portion of the gaseous refrigerant discharged from the compressor as a heat source.

19. The refrigeration apparatus as recited in claim 17, wherein the heating device is a heat exchanger that is arranged to use a portion of the gaseous refrigerant flowing through the liquid refrigerant circuit as a heat source.

20. The refrigeration apparatus as recited in claim 17, wherein the heating device is an electric heating unit.

21. The refrigeration apparatus as recited in claim 17, wherein the heating device is a heat exchanger that is arranged to use an external heat source.

22. A refrigeration apparatus comprising:

a vapor compression type main refrigerant circuit including a compressor, a user-side heat exchanger, a heat-source-side heat exchanger, and a gaseous refrigerant circuit connecting the user-side heat exchanger and the compressor together;

a contaminant collecting container configured to separate contaminants from refrigerant flowing in the gaseous refrigerant circuit when the refrigerant is directed through the gaseous refrigerant circuit;

an inlet pipe branching from the gaseous refrigerant circuit to direct the refrigerant into the contaminant collecting container and connected to an inlet of the contaminant collecting container;

an outlet pipe branching from the gaseous refrigerant circuit at a position downstream of where the inlet pipe branches and connected to an outlet of the contaminant collecting container to return the refrigerant from which the contaminants have been separated by the contaminant collecting container to the gaseous refrigerant circuit; and a main opening/closing device configured to shut off the flow of the refrigerant between a part of the gaseous refrigerant circuit where the inlet pipe branches therefrom and a part of the gaseous refrigerant circuit where the outlet pipe branches therefrom, the outlet pipe including a non-return device that only permits one-directional flow from the contaminant collecting container to the gaseous refrigerant circuit.

* * * * *